US005092368A

United States Patent [19]

Tanaka et al.

[11] Patent Number: 5,092,368

[45] Date of Patent: Mar. 3, 1992

[54] CLOTH ROLLER REPLACEMENT SYSTEM FOR WEAVING MACHINE

[75] Inventors: Kazuhiro Tanaka; Shuichi Kojima; Susumu Kaneko; Takayuki Chikuma, all of Tokyo, Japan

[73] Assignee: Nissan Motor Co., Ltd., Yokohama, Japan

[21] Appl. No.: 544,527

[22] Filed: Jun. 27, 1990

[30] Foreign Application Priority Data

Jun. 28, 1989 [JP] Japan ..... 1-163806

[51] Int. Cl.[5] ..... D03D 51/00

[52] U.S. Cl. ..... 139/1 R; 139/291 C; 242/66; 226/11; 364/470; 364/478; 414/911

[58] Field of Search ..... 139/304, 1 R, 291 C; 364/468, 478, 470; 414/911; 242/66, 79, 78.7, 81, 65, 58.6; 226/11; 340/675

[56] References Cited

U.S. PATENT DOCUMENTS 4,178,969 12/1979 Gotoh et al. ..... 139/1 R
4,203,563 5/1980 Alexander, III et al. .
4,573,856 3/1986 Meyer et al. .
4,606,381 8/1986 Suwa et al. .
4,892,119 1/1990 Hugo et al. .
4,910,837 3/1990 Fujimoto ..... 139/1 R X
4,918,613 4/1990 Iwano et al. .

FOREIGN PATENT DOCUMENTS 61-23060 1/1986 Japan .
64-52852 2/1989 Japan .
1-97241 4/1989 Japan .

*Primary Examiner*—Andrew M. Falik
*Attorney, Agent, or Firm*—Foley & Lardner

[57] ABSTRACT

A cloth roller replacement system for at least one weaving machine, includes an actuating system for removing a full cloth roller from the machine and then installing an empty cloth roller in its place. The system further includes an instrument for measuring a fabric take-up quantity of the machine, a device for presetting a timing for preparation, and a controller for preliminarily making the actuating system ready for replacement at the preset timing for preparation, and then controlling the actuating system to perform the cloth roller replacement without stopping the machine.

30 Claims, 35 Drawing Sheets

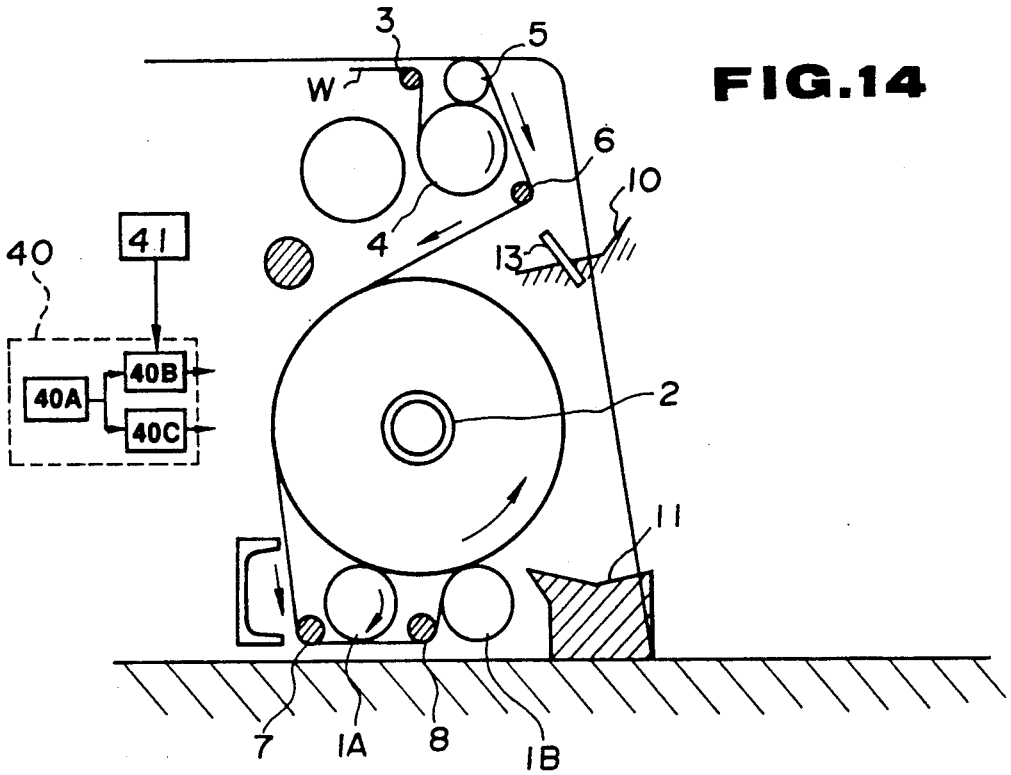
FIG.14
FIG.15
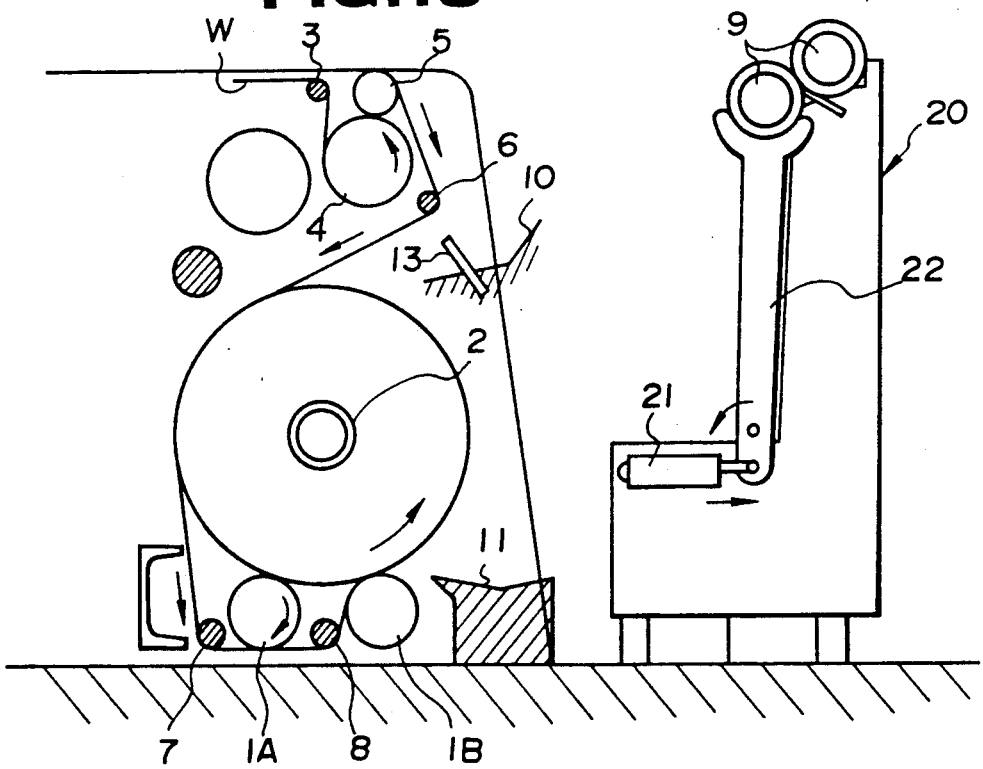

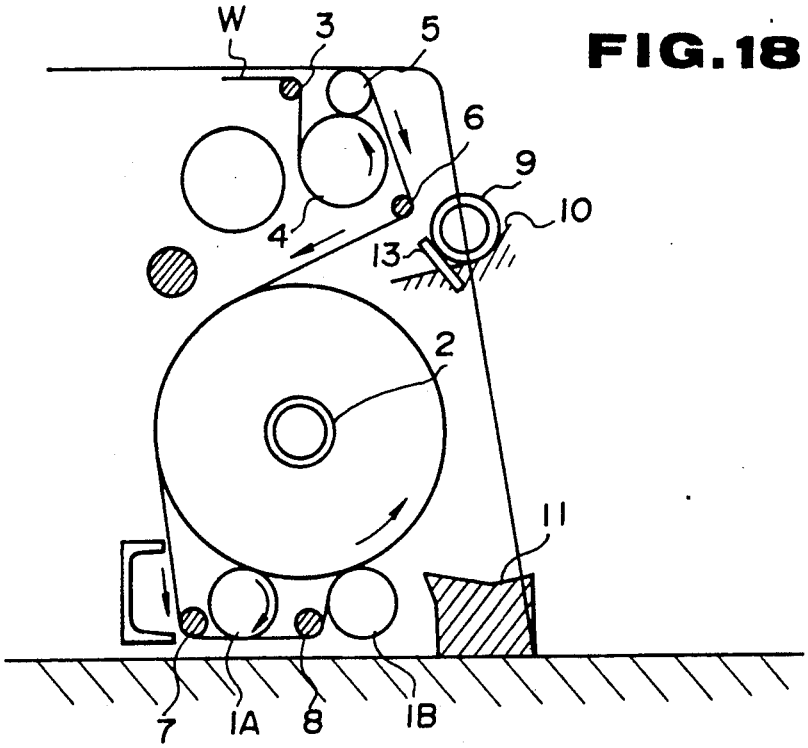
FIG. 18
FIG. 19
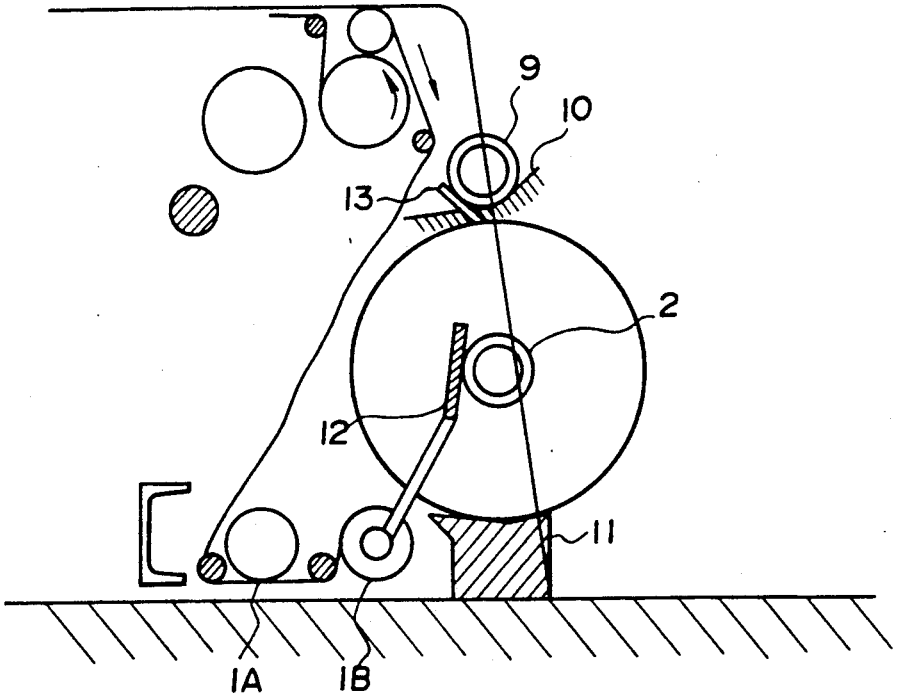

CLOTH ROLLER REPLACEMENT SYSTEM FOR WEAVING MACHINE

BACKGROUND OF THE INVENTION

The present invention relates to a cloth roller replacement system for one or more weaving machines.

The replacement of a full cloth roller with a empty cloth roller is a very troublesome and time consuming job especially in a factory having many weaving machines, and an important factor increasing the down time of each machine.

Various conventional cloth roller replacement systems are disclosed in prior art documents. However, some of the conventional systems are not sufficiently automatic, and some are arranged to initiate a replacement operation without stopping the weaving operation. Therefore, the conventional systems are unsatisfactory in productivity.

SUMMARY OF THE INVENTION

Therefore, it is an object of the present invention to provide a cloth roller replacement system (and/or method) for automatically exchanging cloth rollers without stopping the weaving operation.

According to the present invention, a cloth roller replacement system for at least one weaving machine comprises a measuring means, a commanding means, a presetting means, and a preparing means. The measuring means is a means for sensing an operating condition of the weaving machine, and producing a measuring signal representing a take-up quantity, such as a woven cloth length, of the machine. The commanding means is a means for producing a cloth roller replacement command signal when the take-up quantity becomes equal to a predetermined first value requiring a cloth roller replacement. The presetting means is a means for presetting a second value which is smaller than the first value. The preparing means is a means for producing an advance signal when the take-up quantity becomes equal to the second value. The advance signal is utilized for making preparations for the cloth roller replacement. For example, the advance signal is utilized for preliminary calling a carrier carrying one or more cloth rollers. Therefore, the replacement system of the invention makes it possible to automatically exchange rollers without stopping the weaving operation.

The system of the invention may further comprise means shown in FIG. 1, and claimed in subclaims.

BRIEF DESCRIPTION OF THE DRAWINGS

FIGS. 14–29 are schematic views showing a cloth roller replacement system of the second embodiment in various operating states.

DETAILED DESCRIPTION OF THE INVENTION

A first embodiment of the present invention is shown in FIGS. 2–12.

Figure 3:
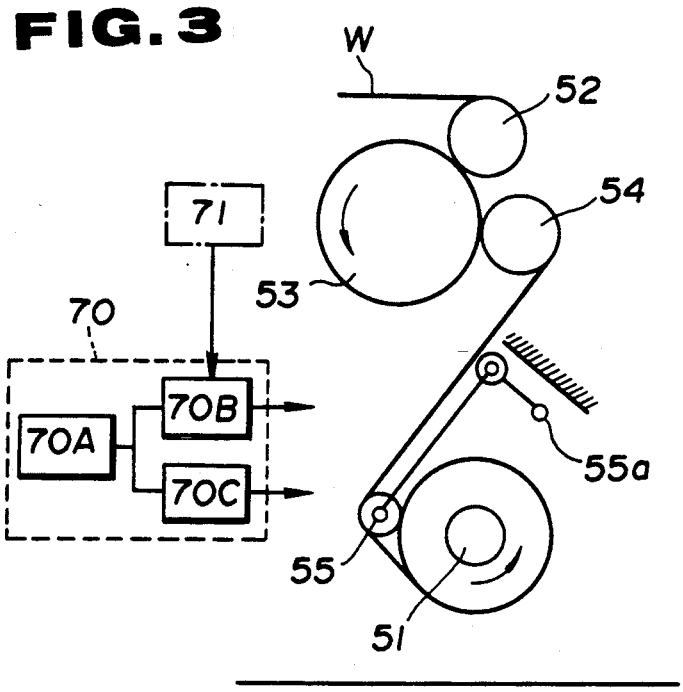
FIGS. 3–12 are schematic views shown a cloth roller replacement system of the first embodiment in various operating states.

A cloth roller replacement system of the first embodiment includes one or more weaving machines. One of the looms is shown in FIG. 3. A fabric take-up mechanism of the weaving machine shown in FIG. 3 has a bearing portion which supports both ends of a cloth roller 51, and a drive shaft which is drivingly connected with one end of the cloth roller or take-up roller 51, and arranged to drive the cloth roller 51 to take-up a woven cloth (fabric) W.

The woven fabric W is drawn away from a cloth fell portion through a press roller 52, a surface roller 53, a press roller 54, and a cloth press roller 55, to the cloth roller 51. The woven fabric W is pulled by the surface roller 53 which is driven by a drive mechanism.

There is further provided at least one carrier 60 which is movable to a service position of each of the weaving machines within a predetermined area, and capable of replacing the cloth roller 51 by an empty cloth roller 61.

The carrier 60 of this embodiment includes a robot arm mechanism 62, a full cloth roller receptacle (or seat) 63 composed of a pair of rollers 63A and 63B, and an empty cloth roller holder 64. The receptacle 63 serves as a means for receiving a full cloth roller removed from the take-up position. The holder 64 serves as a means for holding an empty cloth roller in a standby position.

Each of the weaving machines has a machine controller 70 which is designed to call the carrier 60 and command a replacement of the cloth rollers by producing a signal. The controller 70 includes a first section 70A for monitoring an operating condition of the loom to determine a take-up quantity, a second section 70B for producing an advance signal before the cloth roller 51 becomes full, and a third section 70C for producing a cloth roller replacement command signal when the cloth roller 51 becomes full. It is possible to know the take-up quantity in various manners. For example, it is possible to know the length of woven cloth by counting the number of picks, or the number of revolutions of the main shaft of the loom, or measuring a running time of the loom. In this embodiment, the controller 70 counts the number of picks, and determines the woven cloth length from the count of picks and the filling density. The controller 70 produces the cloth roller replacement command signal when the take-up quantity such as the woven cloth length become equal to a predetermined first value indicative of the fullness of the cloth roller 51, and preliminarily produces the advance signal when the take-up quantity becomes equal to a second value which is smaller than the first value. For example, the controller 70 judges the cloth roller 51 to be full, and produces the replacement command signal when the woven cloth length reaches 150 m. The generation of the advance signal is earlier than the generation of the replacement command signal by 15–30 minutes, or 10,000 picks, for example. The controller 70 is connected with a presetter 71 for presetting the timing for producing the advance signal.

Figure 2:
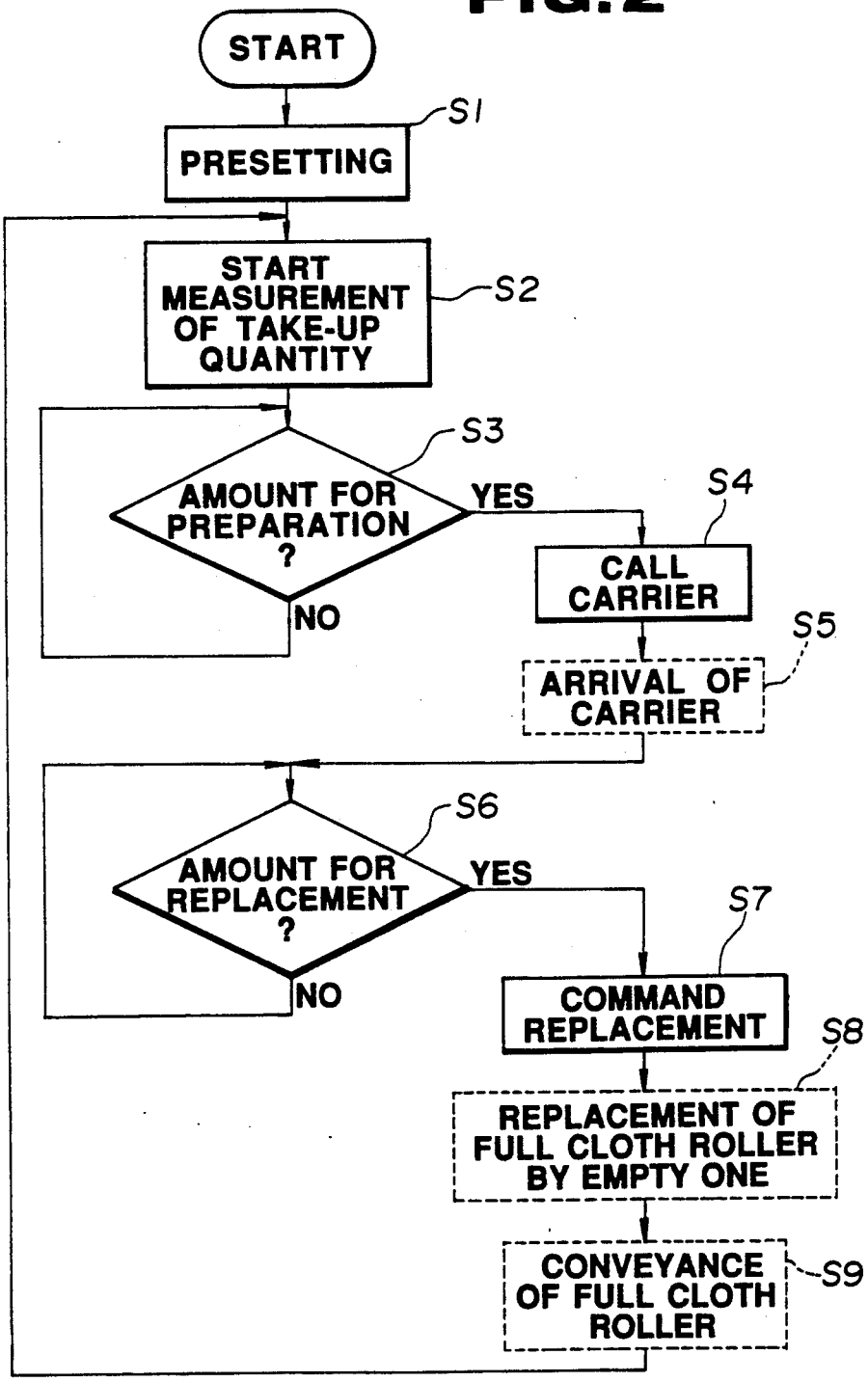
FIG. 2 is a flowchart showing a cloth roller replacement procedure according to a first embodiment of the invention.

FIG. 2 shows a cloth roller replacement procedure according to the first embodiment.

Before the weaving machine is started, the timing for producing the advance signal is preset at a step S1 through the presetter 71. The presetter 71 makes it possible to determine the amount of time by which the occurrence of the advance signal is advanced ahead of the occurrence of the cloth roller replacement command signal. This interval between occurrence of the advance signal and occurrence of the replacement command signal is measured in minutes or number of picks.

Then, the controller 70 starts the measurement of the take-up quantity at a step S2 when the machine is started.

Figure 4:
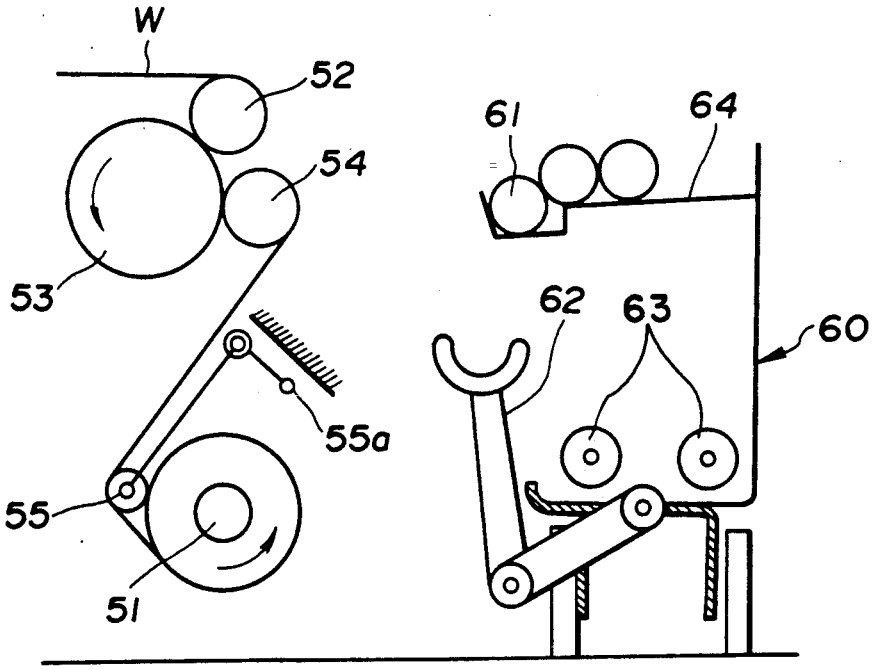

The controller 70 compares the measured take-up quantity with the preset second value at a step S3. When the take-up quantity becomes equal to or greater than the preset second value, then the controller 70 produces the advance signal at a step S4. In this embodiment, the advance signal is sent to a carrier controller for controlling the carrier 60. Upon receipt of the advance signal, the carrier 60 moves automatically to the service position of the weaving machine from which the advance signal is sent (step S5). Then, the carrier 60 stands ready at the service position as shown in FIG. 4 and waits for the next command. An empty cloth roller is held at the standby position near the take-up position of the machine, by the carrier 60 waiting in the service position.

When a plurality of the advance signals are sent from two or more weaving machines, then the carrier controller determines the order of precedence according to the order of receipt of the advance signals, the amounts of time remaining before the cloth roller becomes full, and/or the amounts of time required for the carrier 60 to reach the service positions of the machines, and commands the carrier 60 to go to the machine selected according to the order of precedence.

It is optional to further provide a central controller composed of a host computer which is connected with all the machine controllers and the carrier controller (or all the carrier controllers). In this case, the advance signal is sent to the carrier controller through the central controller to call the carrier. Alternatively, the controller 70 may comprise a signaling device which produces the advance signal which is audible or visual to request a human operator to send the carrier 60.

The controller 70 further compares the measured take-up quantity with the first value which is greater than the second value, and produces the cloth roller replacement command signal indicating that the cloth roller 51 has become full, when the take-up quantity becomes equal to or greater than the first value (steps S6 and S7). In this embodiment, the cloth roller replacement command signal is sent from the machine controller 70 to the carrier controller mounted on the carrier 60 waiting in the service position.

In response to the cloth roller replacement command signal, the carrier 60 exchanges the full cloth roller 51 for an empty cloth roller 61 by performing a sequence of operations shown in FIGS. 5–12 (step S8).

Figure 5:
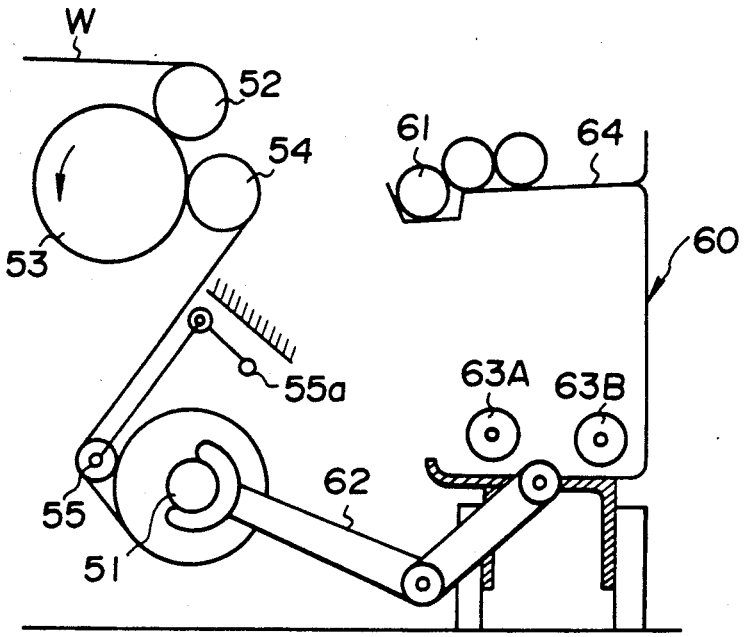

First, the robot arm mechanism 62 mounted on the carrier 60 stretches its robot arm forward toward the weaving machine, and grips both ends of the full cloth roller 51 located in the take-up position, as shown in FIG. 5. At the same time, the full cloth roller 51 is disconnected from the drive shaft of the fabric take-up mechanism of the weaving machine.

Figure 6:
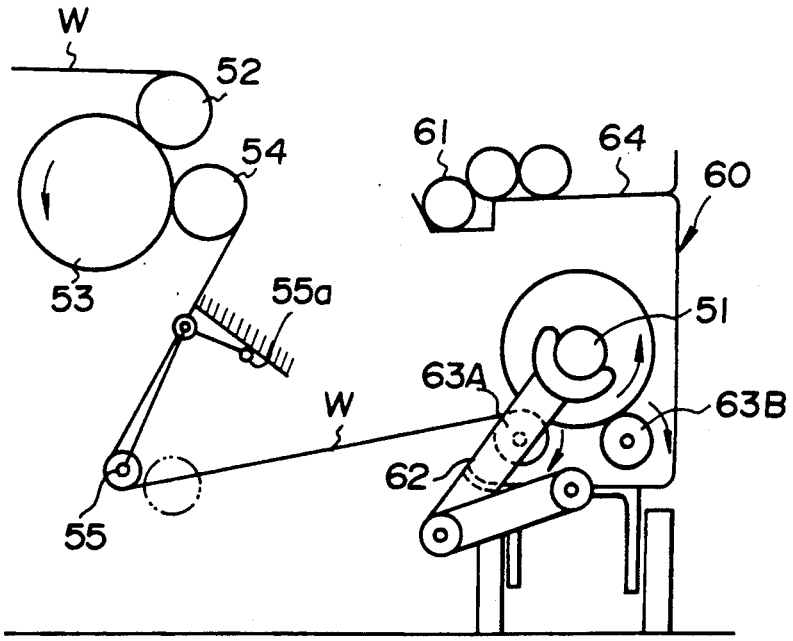

Second, the robot arm mechanism 62 transfers the full cloth roller 51 from the take-up position within the machine, onto the full cloth roller receptacle 63 of the carrier 60. Thus, the full cloth roller 51 is securely placed on the rollers 63A and 63B of the receptacle 63, as shown in FIG. 6. The robot arm mechanism 62 serves as a means for removing a full cloth roller from the take-up position. On the receptacle 63 of the carrier 60, the full cloth roller 51 is driven by at least one of the rollers 63A and 63B, and further takes up the woven fabric. The weaving machine includes a stopper 55*a* which limits a swing movement of the cloth press roller 55 and holds the cloth press roller 55 at a position which is slightly apart from the take-up position. Therefore, the empty cloth roller 61 can be placed in the take-up position without being obstructed by the cloth press roller 55. The cloth press roller 55 guides the woven cloth W advancing from the press roller 54, toward the full cloth roller 51 placed on the carrier 60, as shown in FIG. 6.

Figure 7:
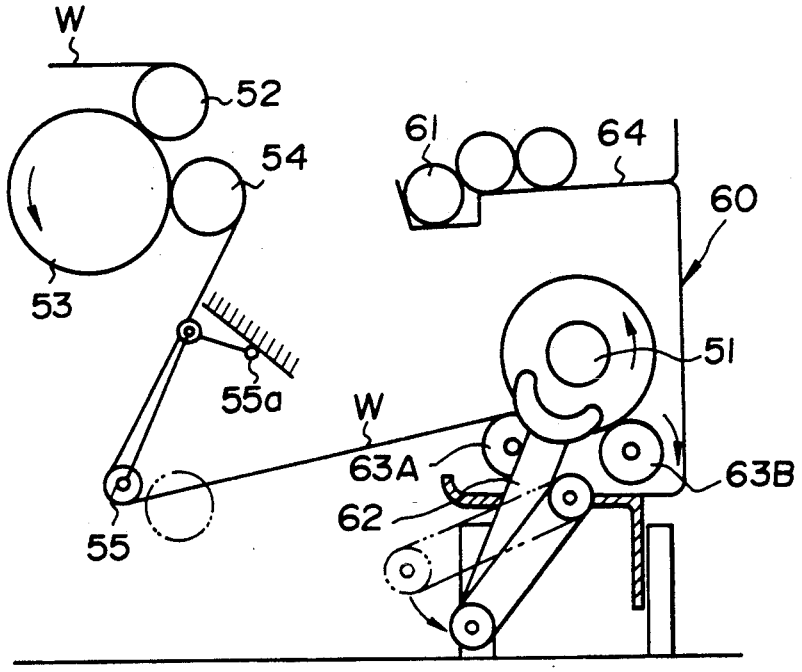
Figure 8:
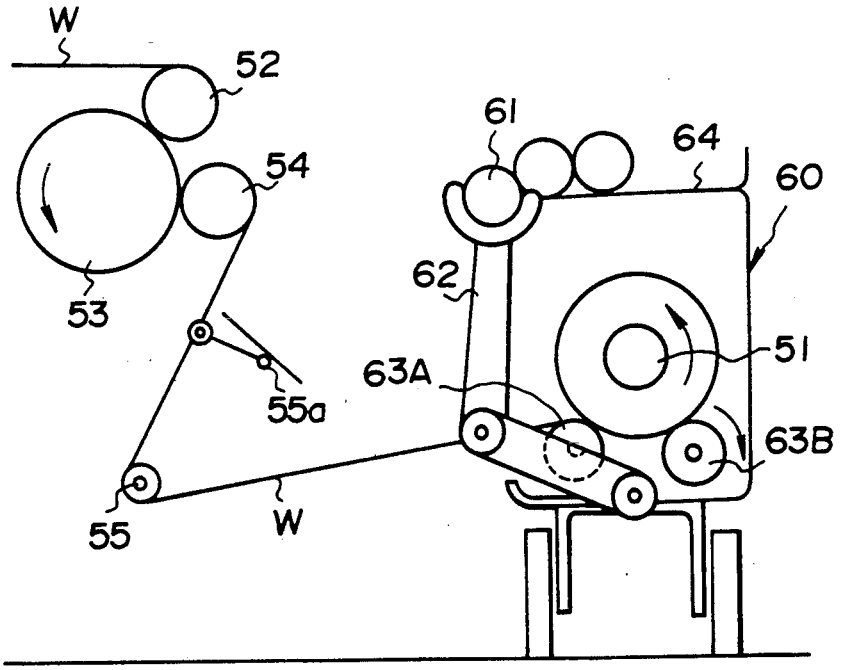

The robot arm mechanism 62 then withdraws its arms from the full cloth roller 51 as shown in FIG. 7, and stretches its arms upwardly toward the empty cloth roller holder 64 located above the full cloth roller receptacle 63. In a state shown in FIG. 8, the robot arms of the mechanism 62 grip one of the empty cloth roller 61 laid up in the empty cloth roller holder 64. In FIG. 8, the robot arms grip the leftmost empty roller 61.

Figure 9:
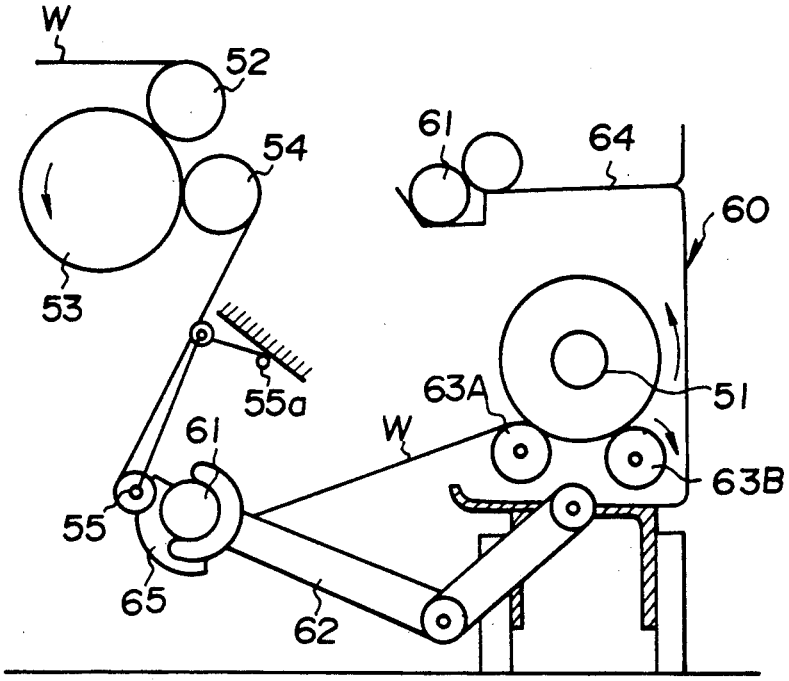

Then, the robot arm mechanism 62 transfers the empty roller 61 in its grip from the carrier 60 to the take-up position of the weaving machine, as shown in FIG. 9. Thus, the empty roller 61 is positioned in the take-up position, and both ends of the empty roller 61 are supported on a roller rest 65 as shown in FIG. 9. Thereafter, the empty cloth roller 61 is drivingly connected with the drive shaft of the take-up motion (i.e. mechanism). In this state, the full cloth roller 61 is still rotating on the roller 63A and 63B of the carrier 60 and drawing the cloth W under a predetermined tension. Therefore, the cloth W advances from the cloth press roller 55, passes under the empty cloth roller 61 installed in the take-up position, and reaches the full cloth roller 51 on the carrier 60, as shown in FIG. 9.

Figure 10:
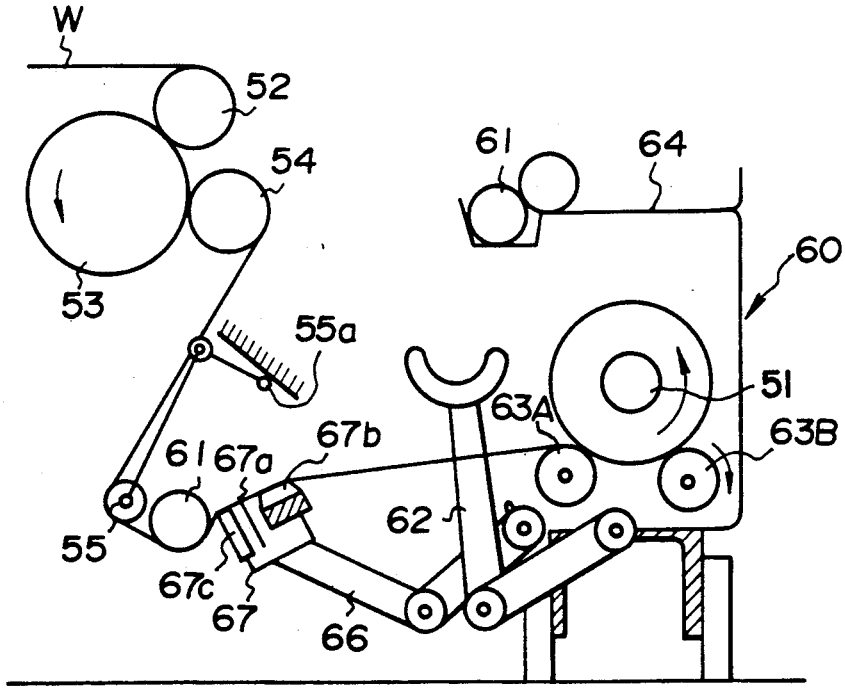

Then, a cutting device 67 of the carrier 60 cuts the woven cloth W in the widthwise direction at a position between the empty cloth roller 61 held in the take-up position of the machine and the full cloth roller 51 held on the carrier 60, as shown in FIG. 10. The cutting device 67 is carried by at least one arm 66 of the carrier 60, and thrust out to a cutting position near the empty cloth roller 61 as shown in FIG. 10. The cutting device 67 includes a cutter blade 67*a*, a guide member 67*b* extending in the widthwise direction, and an air nozzle unit 67*c*. The cutter blade 67*a* is interposed between the guide member 67*b* and the air nozzle unit 67*c*, and movable in the widthwise direction from one end of the woven cloth W to the other end. In the cutting position, the cutting device 67 pushes the woven cloth W upwardly to a limited extent.

Figure 11:
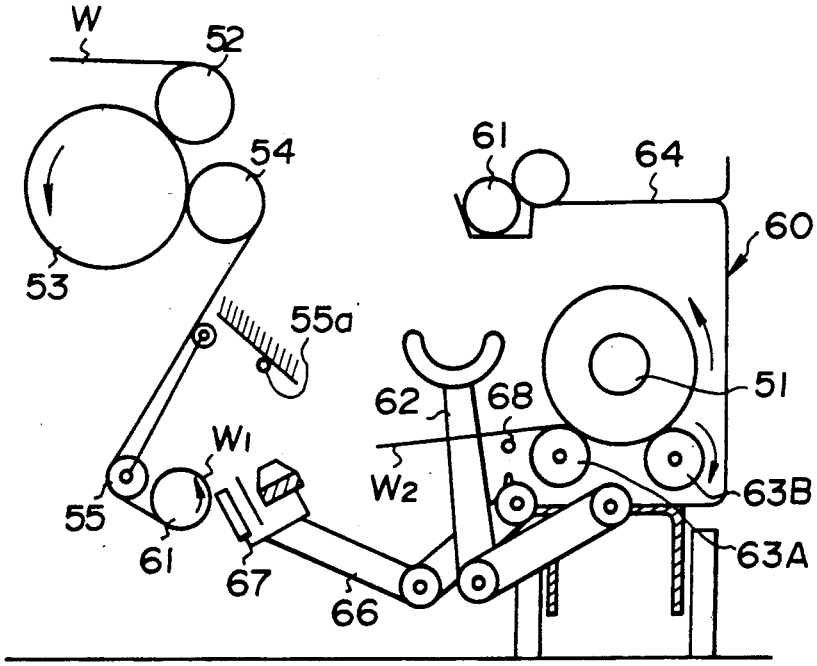

On the weaving machine's side, a cut end $W_1$ of the woven cloth W is blown upwardly and obliquely by air ejected from the air nozzle unit 67*c*, and rolled around the empty cloth roller 61, as shown in FIG. 11. Thus, the empty cloth roller 61 starts taking up the woven cloth W. The timing of the air ejection is adjusted so as to roll the cut end $W_1$ around the empty roller 61 immediately without delay. In order to facilitate adhesion between the cloth end $W_1$ and the outside cylindrical surface of the empty roller 61 in cooperation with or in lieu of the air ejection of the air nozzle unit 67*c*, it is optional to provide a means for sucking air into the empty roller 61, or to apply water, magic tape or some other adhesive material to the outside cylindrical surface of the empty roller 61. On the carrier's side, a cut end $W_2$ of the cloth is taken up by the full cloth roller 51 on the rollers 63A and 63B, as shown in FIG. 11. The carrier 60 of this embodiment is equipped with a detector 68, disposed near the roller 63A, for detecting the cloth end $W_2$. The carrier controller stops the rotation of the rollers 63A and 63B when the detector 68 produces a signal indicating the passage of the cloth end $W_2$.

Figure 12:
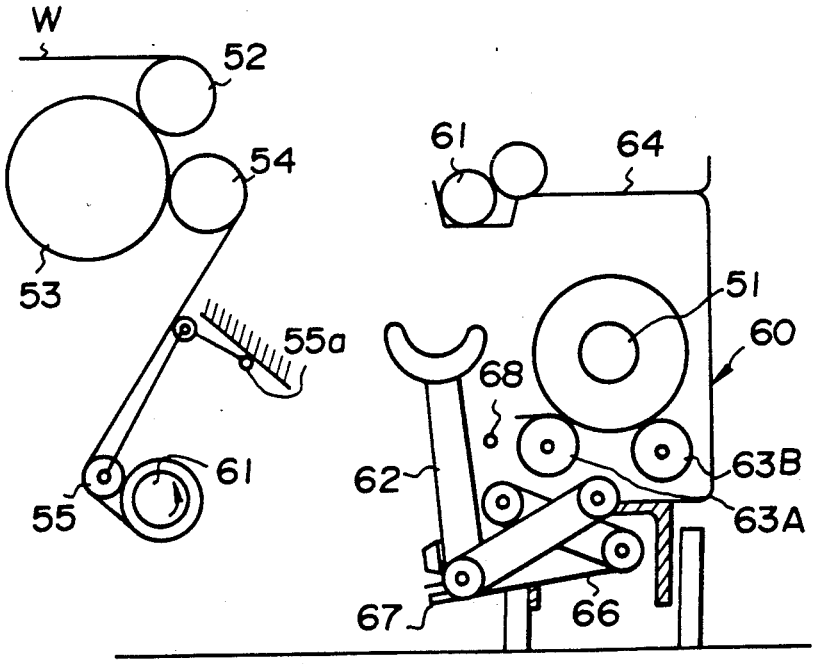

The carrier 60 then retracts its cutting device 67 as shown in FIG. 12, and completes the cloth roller replacement service for this weaving machine. The full cloth roller 51 is carried by the carrier 60 to a predetermined station (step S9).

Figure 1:
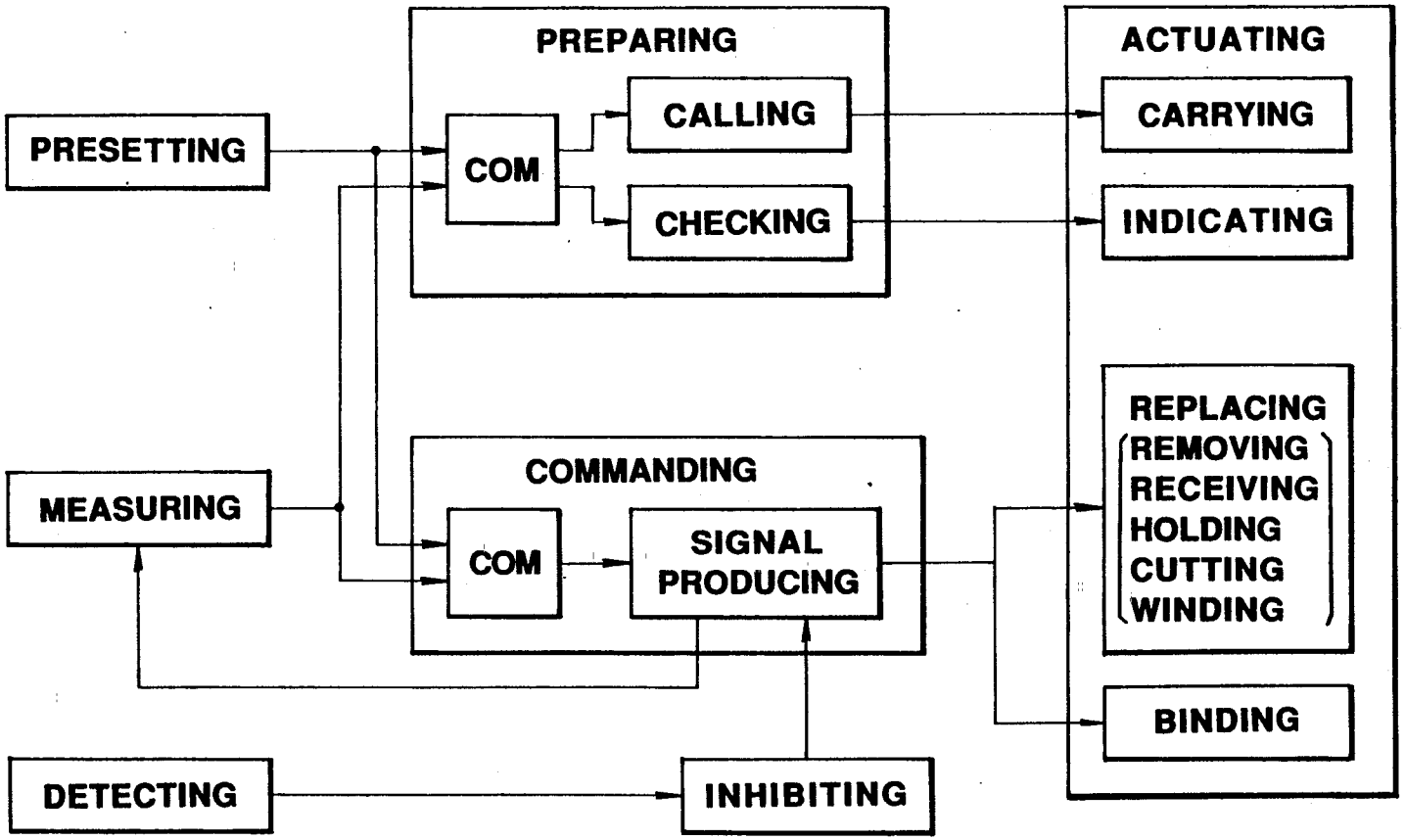
FIG. 1 is a block diagram showing, as an example, an arrangement of various means appearing in claims.

In this way, the cloth roller replacement system of the first embodiment can improve the efficiency of the weaving machines, and make the full cloth rollers uniform by exchanging cloth rollers smoothly without stopping the weaving operation. The replacement system is arranged to call the carrier before the cloth roller become full. Therefore, the system of this embodiment can save a waiting time for the carrier, and carry out the replacement immediately when the cloth roller becomes full. The time for calling the carrier is adjustable with the presetter 71, so that it is possible to minimize the time for the carrier to wait at the service position, and make the most use of the carrier. The thus-constructed cloth roller replacement system of the first embodiment comprises a measuring means, a commanding means, a presetting means, a preparing means and an actuating means, as shown in FIG. 1. The measuring means senses an operating condition of the weaving machine, and produces a measuring signal representing a measuring which is a physical quantity to be measured. In this embodiment, the measuring is the take-up quantity. The commanding means produces a replacement command signal when the take-up quantity becomes equal to a first value requiring a cloth roller replacement. The actuating means receives the command signal, and preforms a cloth roller replacement. The presetting means is a means for presetting a second value smaller than the first value. The preparing means produces an advance signal when the take-up quantity becomes equal to the second value. In this embodiment, the presetting means comprises the presetter 71, and the preparing means comprises a comparing means and a calling means, as shown in FIG. 1. The step S2 shown in FIG. 2 corresponds to the comparing means, and the step S4 corresponds to the calling means. The actuating means of this embodiment comprises a carrying means which comprises the carrier 60, and a replacing means (or replacing mechanism), as shown in FIG. 1. The replacing means comprises the above-mentioned removing means, holding means, and receiving means. The replacing means further comprises a cutting means which comprises the cutter blade 67, and a winding means which comprises the air nozzle unit 67*c*. The commanding means comprises a comparing means corresponding to the step S6, and a signal producing means corresponding to the step S7.

A second embodiment of the invention is shown in FIGS. 13A and 14–29.

A cloth roll replacement system of the second embodiment includes one or more weaving machines. As shown in FIG. 14, each machine has a fabric take-up mechanism (motion) of a surface drive type. A cloth roller 2 is placed on a pair of support rolls 1A and 1B. The rear support roll 1A is driven by a motor, and drives the cloth roller 2. The woven cloth W is drawn from the reed through a guide bar 3 by a surface roller 4 which is driven by a driving member (not shown). From the surface roller 4, the cloth W further advances through a press roller 5, a guide bar 6, the outside surface of the cloth roller 2, and guide bars 7 and 8, and then passes between the support rollers 1A and 1B.

Each machine of this embodiment has an empty roll holder 10 (stoker), and a cloth seat 11. The roll holder 10 is located above the support rollers 1A and 1B, and the cloth seat 11 is located ahead of the support rolls 1A and 1B. The cloth seat 11 is positioned more remotely from the rear end of the weaving machine than the rolls 1A and 1B. The holder 10 serves as the holding means, and the cloth seat 11 serves as the receiving means.

Figure 22:
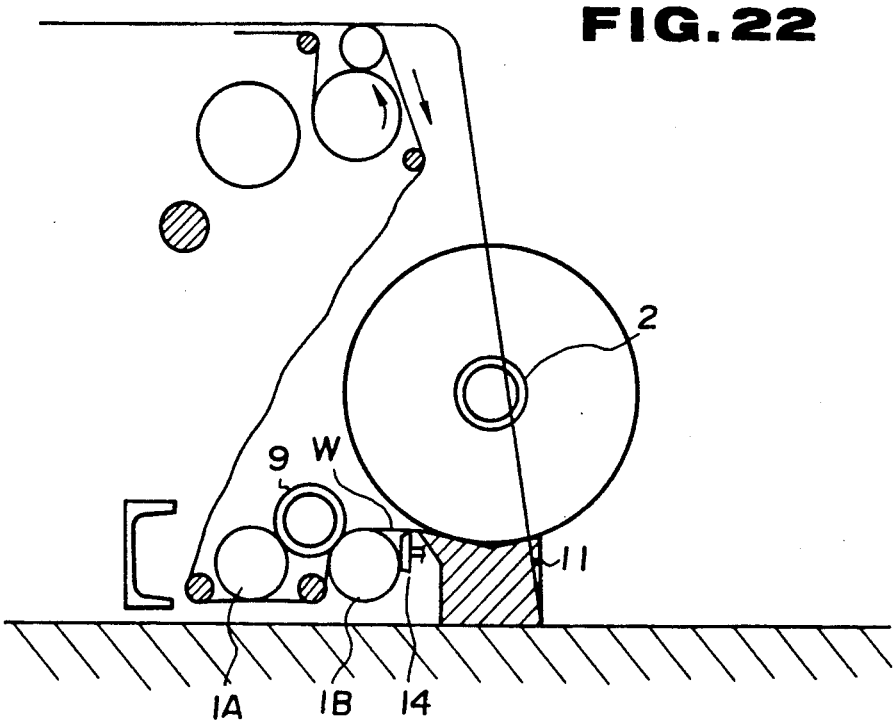
Figure 23:
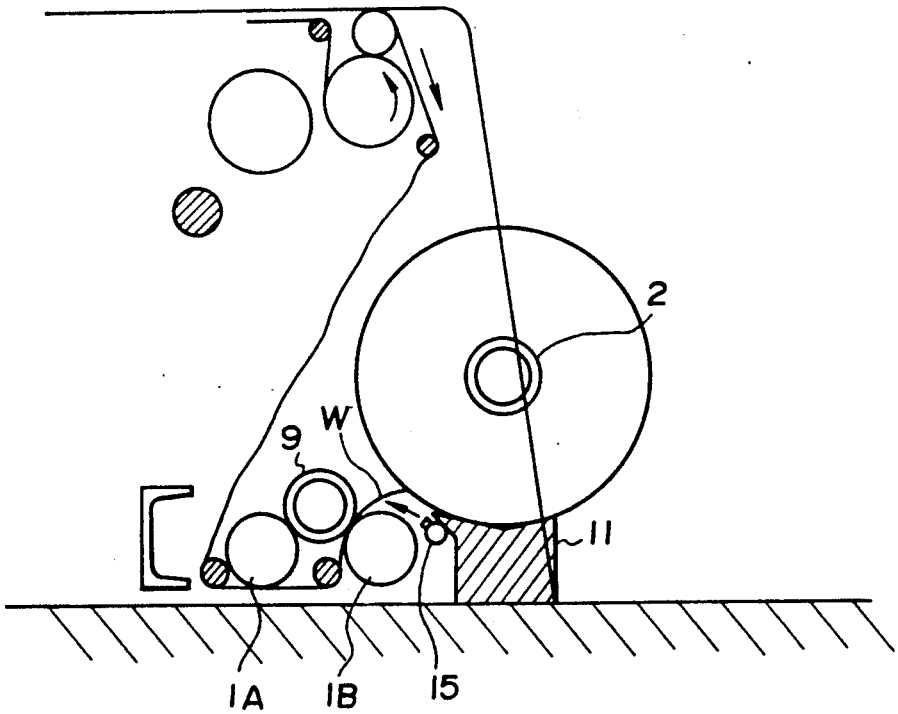
Figure 26:
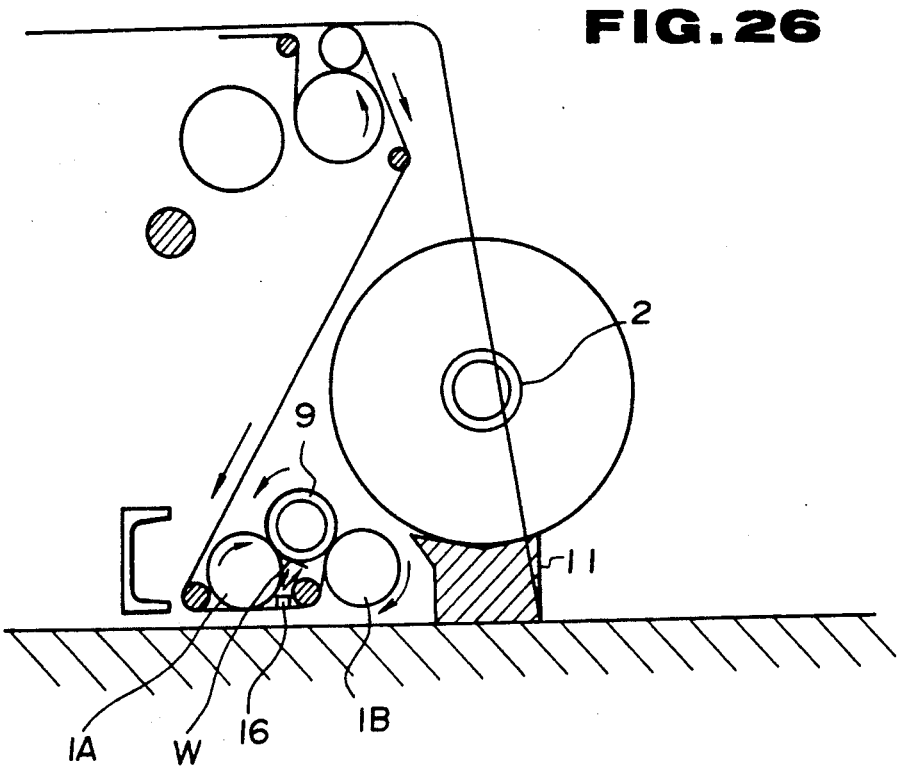

Each machine of this embodiment further includes a cloth roll replacing (auto-doffing) mechanism which includes a pushing lever mechanism 12 shown in FIG. 19, an empty roll stopper 13, a rotary cutter 14 shown in FIG. 22, a first air nozzle unit 15 shown in FIG. 23, and a second air nozzle unit 16 shown in FIG. 26. A machine controller 40 is connected with the cloth roll replacing mechanism, and designed to control the operation of each component of the replacing mechanism.

The pushing lever mechanism 12 includes levers which can rotate about the axis of the front support roll 1B, and shove the full cloth roller 2 from the support rolls 1A and 1B to the cloth seat 11 by pushing both ends of the cloth roller 2, and one or more actuators such as air cylinders for causing the levers to rotate. The lever mechanism 12 serves as the removing means.

The empty roll stopper 13 is connected with an actuator, such as an electromagnetic actuator. The actuator of the stopper 13 can move the stopper 13 from a hold position for holding the empty cloth roller 9 in the empty roll holder 10, as shown in FIGS. 16–19, to a release position for releasing the empty roller 9. The stopper 13 serves as the holding means.

The rotary cutter 14 is driven by an air turbine or some other means capable of rotating the cutter 14 at high speeds. The cutter 14 is arranged to cut the cloth W at a position between the front support roll 1B and the cloth seat 11 by moving from the left and of the cloth W to the right end. The cutter 14 serves as a cloth cutting means.

The first and second air nozzle units 15 and 16 are arranged to cooperate to wind a cut end of the cloth W on the empty cloth roller 9 on the support rolls 1A and 1B. The first air nozzle unit 15 is positioned between the front roll 1B and the cloth seat 11, as shown in FIG. 23, and the second air nozzle unit 16 is positioned between the rear and front support rolls 1A and 1B, as shown in FIG. 26. Each of the air nozzle units 15 and 16 extends in the widthwise direction of the cloth, and has a plurality of spouts (holes) arranged at regular intervals in a straight line extending in the widthwise direction. The air nozzle units 15 and 16 serve as a winding means.

Figure 16:
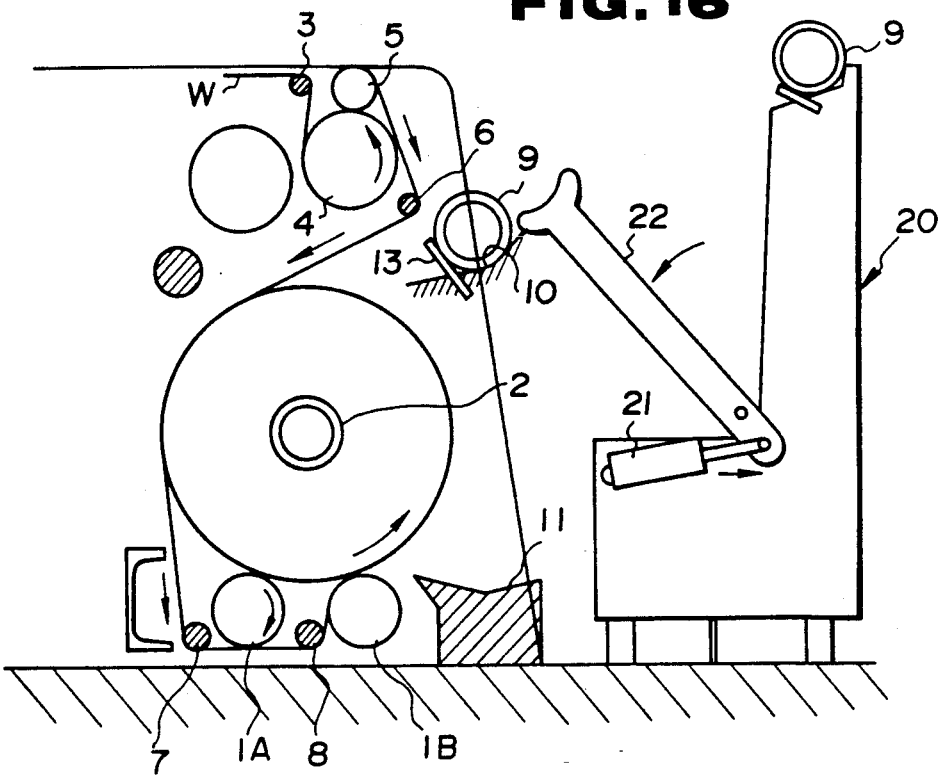

The cloth roller replacement system of the second embodiment employs at least one empty roll carrier 20 and at least one cloth carrier 30. The empty roll carrier 20 can move automatically to the service position of each of the weaving machines within a predetermined range, and supply an empty cloth roller to the empty roll holder 10 of each machine under its change, as shown in FIGS. 15 and 16. The cloth carrier 30 shown in FIG. 28 can move automatically to the service position of each of the machines within a predetermined range, and transport a full cloth roller from each machine to a predetermined station. Each carrier has a carrier controller which receives signals from the machine controllers. The carriers 20 and 30 serves as a carrying means.

The machine controller 40 shown in FIG. 14 includes a first section 40A for measuring the take-up quantity by monitoring an operating condition of the weaving machine, a second section 40B for producing an advance signal shortly before the cloth roller 2 becomes full, and a third section 40C for producing a cloth roller replacement command signal when the take-up quantity amounts to such a value as to make the cloth roller 2 full. The first section 40A serves as the measuring means, the second section 40B serves as the preparing means, and the third section 40C serves as the commanding means. A presetter 41 is connected with the machine controller 40.

Figure 13A:
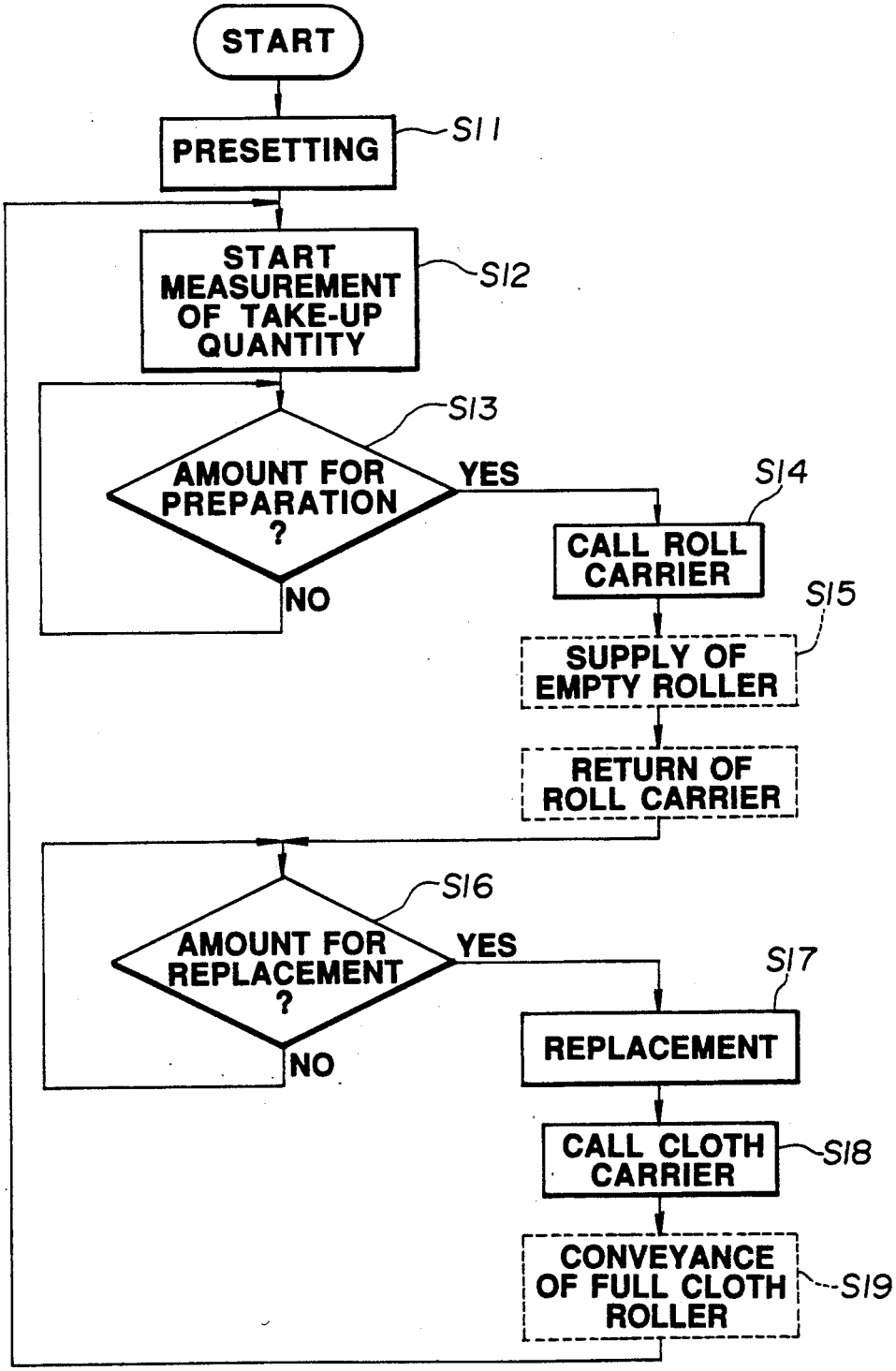
FIG. 13A is a flowchart showing a cloth roller replacement procedure according to a second embodiment of the invention.

FIG. 13A shows a procedure of the second embodiment, for exchanging cloth rollers.

The first step S11 is a step for presetting a time for producing the advance signal through the presetter 41 before an start of the weaving machine. At a next step S12, the machine controller 40 starts measurement of the take-up quantity when the machine is started.

Figure 17:
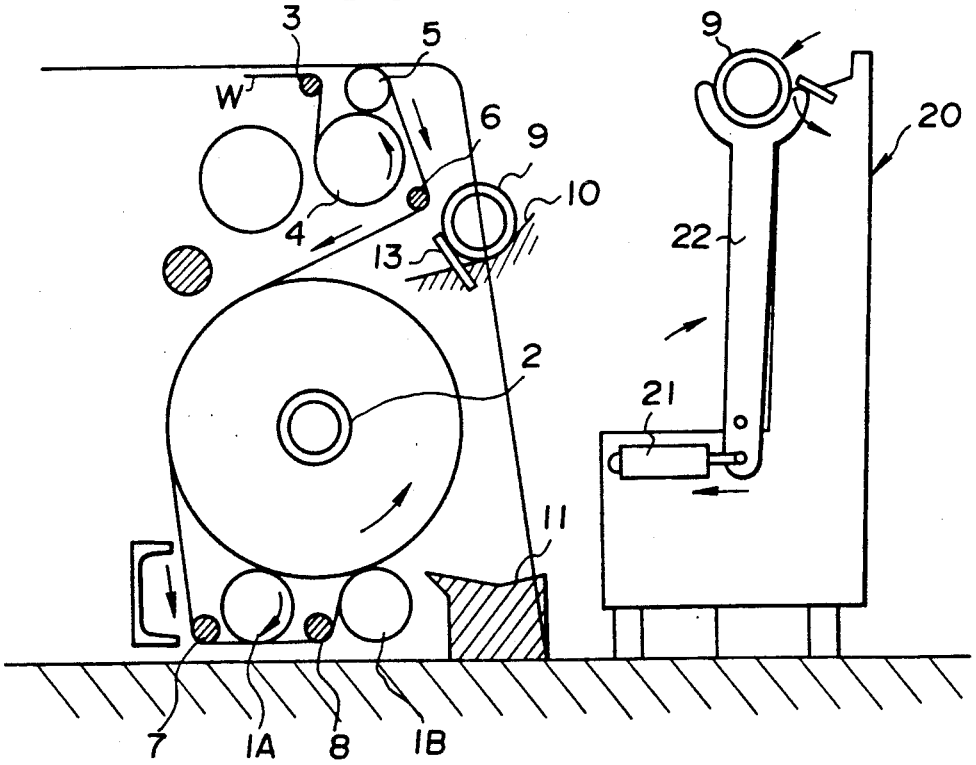

At a step S13, the machine controller 40 compares the measured take-up quantity with a preset value. The step 13 corresponds to a comparing means included in the preparing means. When the take-up quantity becomes equal to or greater than the preset value, then the controller 40 calls the empty roll carrier 20 at a step S14 by delivering the advance signal to the controller of the empty roll carrier 20. In response to the advance signal, the empty roller carrier 20 automatically moves to the service position of the machine as shown in FIG. 15. At the service position, the carrier 20 moves its arm structure 22 with at least one air cylinder 21 from an upright position shown in FIG. 15 to a slant position shown in FIG. 16, and places one of empty cloth rollers 9 on the empty roll holder 10 of the machine, as shown in FIG. 16 (step S15). The arm structure 22 is retracted to the upright position, and another empty cloth roller 9 is supplied onto the arm structure 22, as shown in FIG. 17. Then, the empty roll carrier 20 retires from the service position of this machine. The step 14 corresponds to a calling means included in the preparing means.

When the measured take-up quantity amounts to a predetermined value indicative of the fullness of the cloth roller 2, then the machine controller 40 commands the cloth roll replacing mechanism of the machine to exchange cloth rollers by sending the cloth roller replacement command signal (steps S16 and S17). The step S16 corresponds to a comparing means included in the commanding means.

It is optional to provide a sensor for detecting the presence of an empty cloth roller 9 in the holder 10, and a circuit which produces an alarm signal, stops the weaving machine, and call the empty roll carrier 20 again if no empty cloth roller is stored in the holder 10.

The replacing mechanism of this embodiment exchanges cloth rollers in the following manner.

First, the replacing mechanism stops the drive of the support roller 1A. However, the drive of the surface roller 4 remains in action, and the weaving machine continues the weaving operation. Then, as shown in FIG. 19, the pushing lever mechanism 12 shoves the full cloth roller 2 forwardly from the take-up position to the cloth seat 11 by rotating the levers in the clockwise direction in FIG. 19.

Figure 20:
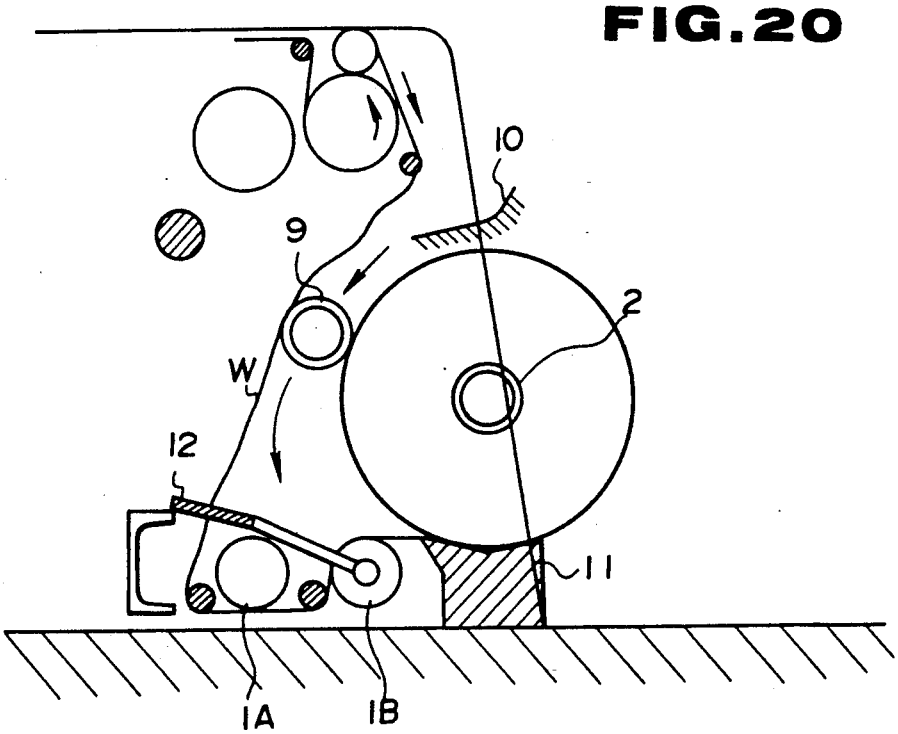

The cloth seat 11 of this embodiment is provided with a detecting device such as a limit switch for detecting the safe receipt of the full cloth roller 2. After the full cloth roller 2 has been safely placed on the cloth seat 11, the replacing mechanism retracts the pushing lever mechanism 12 as shown in FIG. 20.

Figure 21:
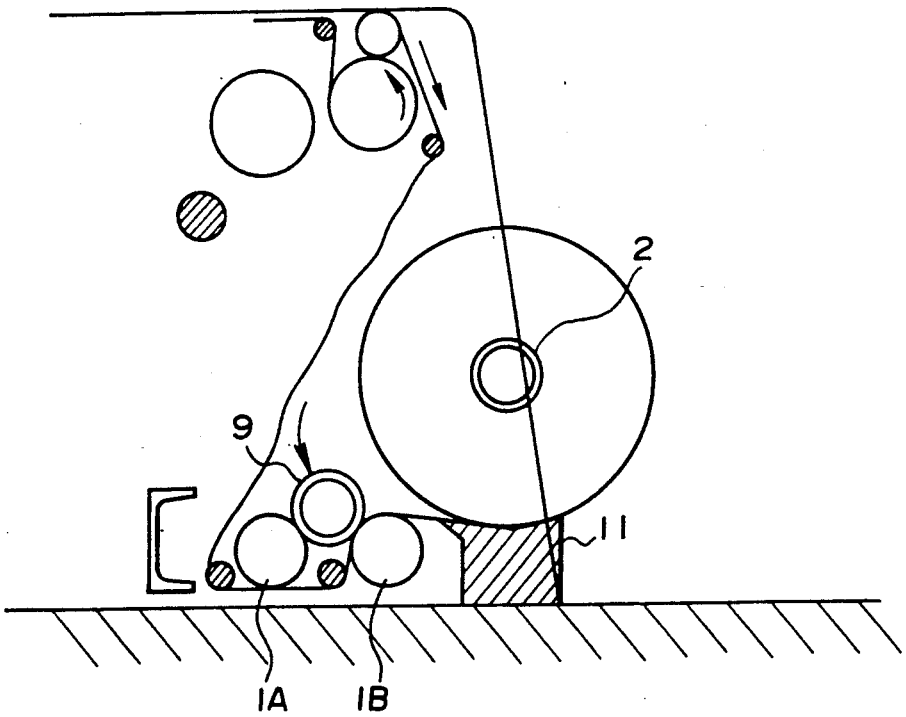

Then, the replacing mechanism moves the empty roll stopper 13 from the hold position to the release position, and thereby permits the empty cloth roller 9 to fall from the empty roll holder 10. Therefore, the empty cloth roller 2 passes downwardly between the full cloth roller 2 and the woven cloth W as shown in FIG. 20, falls on the pushing arms 12, and descends by rolling along the pushing arms 12 to the take-up position between the support rolls 1A and 1B, as shown in FIG. 21. There is formed an appropriate guide way for guiding the empty roller 9 from the holder 10 to the take-up position.

After the arrival of the empty cloth roller 9 at the take-up position is confirmed by a sensor such as a photoelectric sensor provided between the support rolls, the replacing mechanism rotates the rotary cutter 14 provided between the front support roll 1B and the cloth seat 11 as shown in FIG. 22, and moves the rotary cutter 14 from the left end of the cloth W to the right end. Thus, the cloth is cut in the widthwise direction at the cutting position between the rear support roll 1B and the cloth seat 11.

Figure 24:
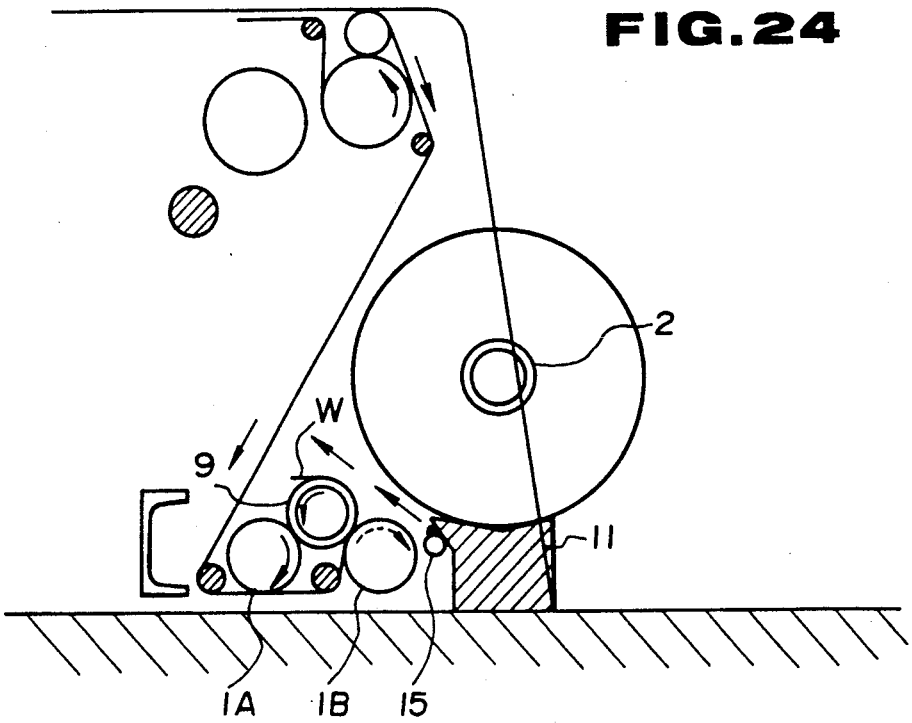
Figure 25:
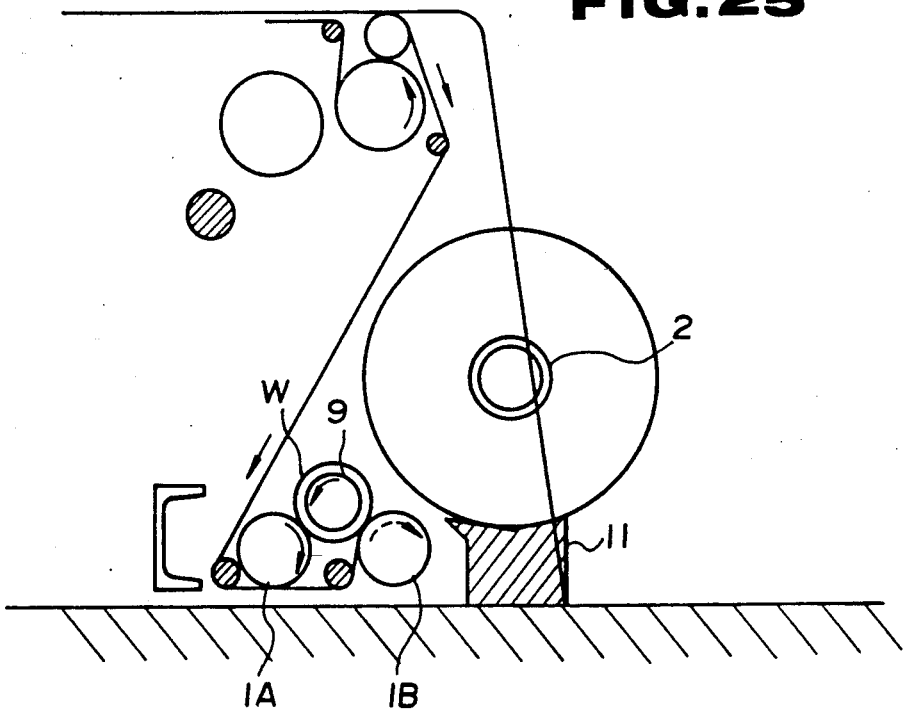

After the arrival of the cutter 14 at the right end is confirmed, the replacing mechanism causes the first air nozzle unit 15 to eject air jets as shown in FIG. 23, and drives the support roll 1A. Therefore, the cut end of the cloth W is blown rearwardly over the empty cloth roller 9, as shown in FIG. 24, and wound around the rotating empty cloth roller 9, and inserted between the cloth roller 9 and the support roll 1A, as shown in FIG. 25.

Then, the second air nozzle unit 16 ejects air jets in an upward direction so as to separate the cloth end from the support roll 1A, and air jets in a forward and upward direction so as to insert the cloth end between the cloth roller 9 and the support roll 1B, as shown FIG. 26. Thus, the second air nozzle unit 16 prevents the cloth end from hanging down, and causes the cloth end to be caught in between the cloth roller 9, and a downstream portion of the cloth W advancing upwardly from the guide bar 8 toward the cloth roller 9. Thereafter, the cloth roller 9 can take-up the cloth continuously without aid from the air nozzle units 15 and 16.

Figure 28:
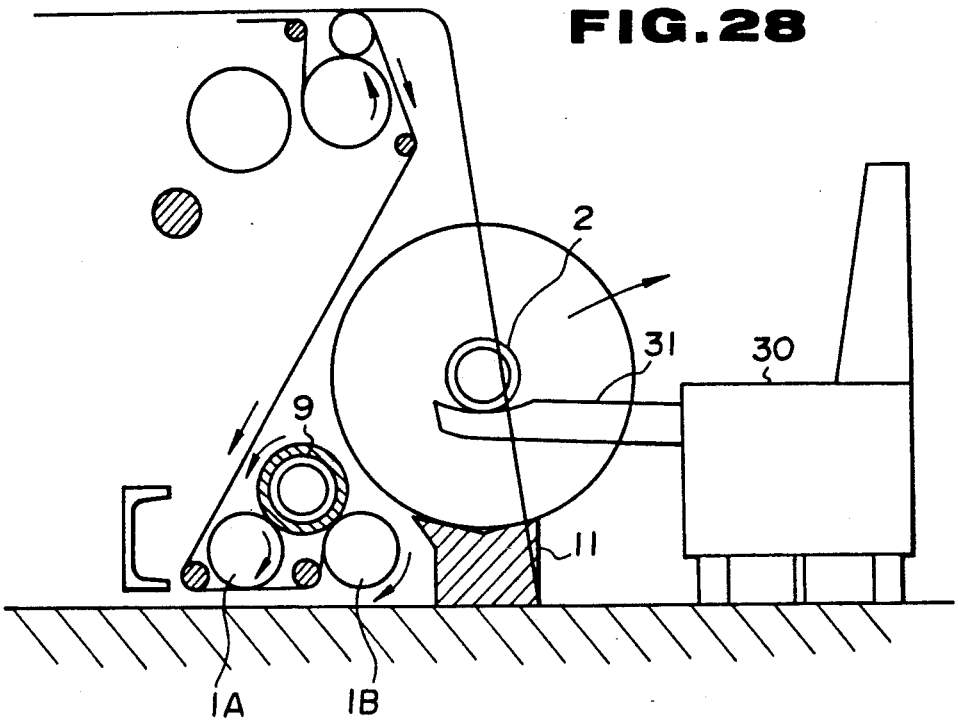
Figure 29:
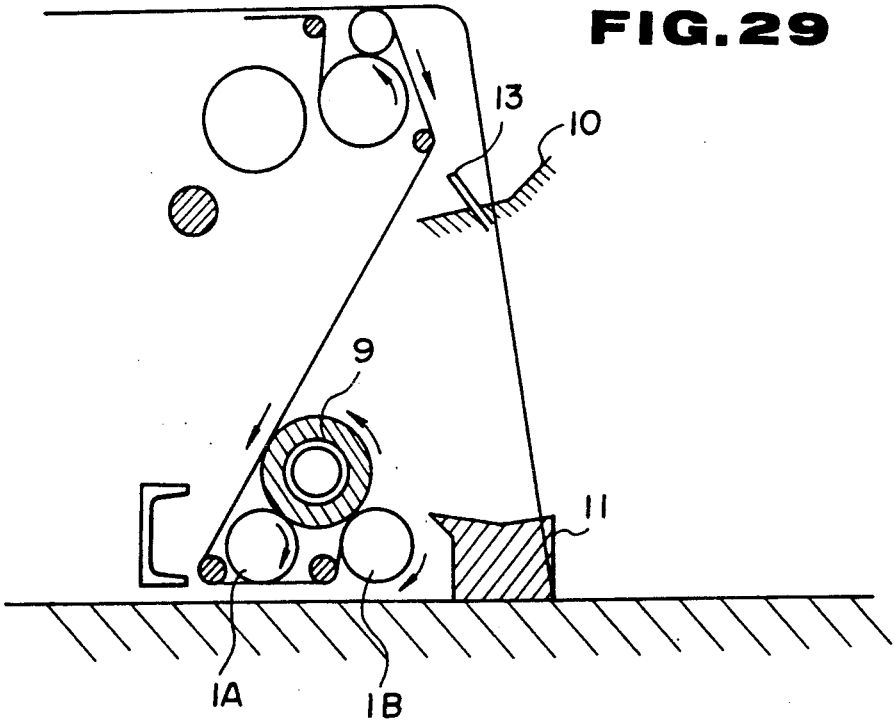

Then, the condition of the cloth W is checked to make sure that the cloth W is wound around the cloth roller 9, by sensing a tension of the cloth W, or using a feeler which touches the surface of the cloth roller 9 and swings. After that, the machine controller 40 calls the cloth carrier 30 by producing a signal (step S18). In response to the signal of the machine controller 40, the cloth carrier 30 comes to the service position of this machine, as shown in FIG. 28. At the service position, a robot arm structure 31 of the cloth carrier 30 is operated to lift up the full cloth roller 2 from the cloth seat 11, and load the full cloth roller 2 onto the cloth carrier 30. Then, the cloth carrier 30 conveys the full cloth roller 2 away from the service position of the machine (step S19). Thereafter, the weaving machines continues the normal weaving operation as shown in FIG. 29.

Figure 27:
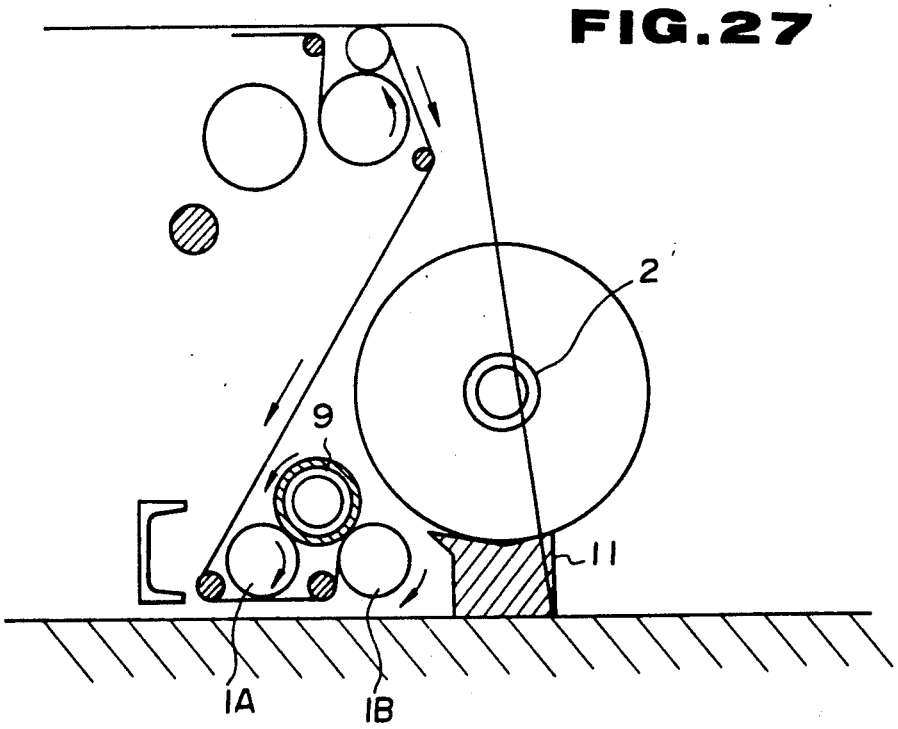

In the second embodiment, the cloth carrier 30 need not come immediately to the service position, because the weaving machine of the second embodiment can continue the normal weaving operation with the new cloth roller 9 even when the full cloth roller 2 remains on the cloth seat 11, as shown in FIG. 27. Therefore, it is possible to deal with more weaving machines with only one cloth carrier 30.

It is optional to further provide a binding mechanism which can bind the full cloth roller 2 on the cloth seat 11. The replacement system of the second embodiment employs the carriers 20 and 30 of two different kinds. However, it is possible to employ a carrier which combines the function of the empty roll carrier 20 and the function of the cloth carrier 30.

Figure 13B:
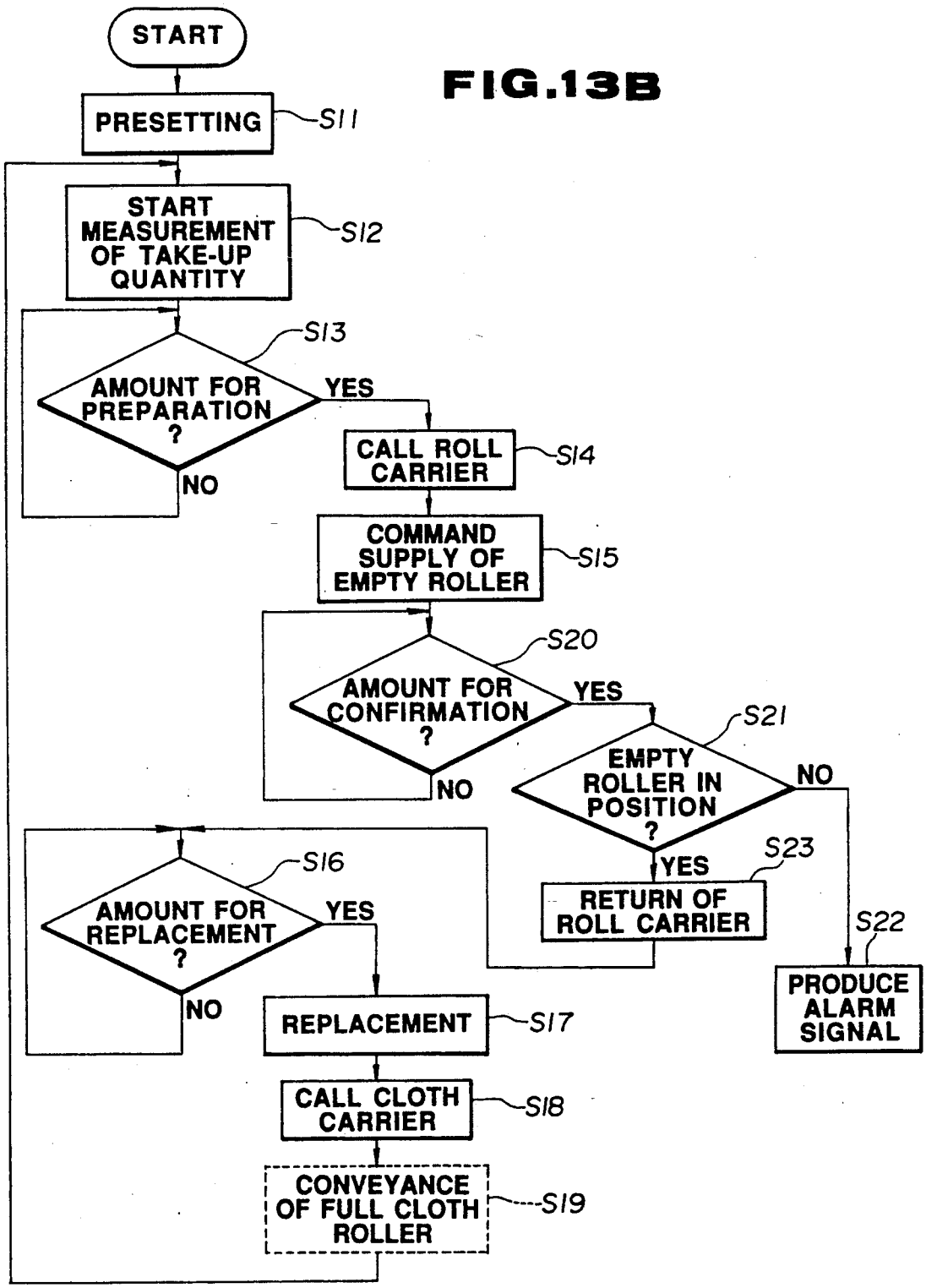
FIG. 13B is a flowchart showing a variation of the procedure of the second embodiment.

FIG. 13B shows a variation of the procedure shown in FIG. 13A. In the procedure of FIG. 13B, steps S20–S23 are interposed between the step S15 and the step S16. After the step S15, the machine controller 40 compares the measured take-up quantity with a predetermined value at a step S20, and checks the supply of an empty cloth roller 9 at a step S21 when the take-up quantity amounts to the predetermined value. When an empty cloth roller 9 is in position, then the roll carrier 20 retreats from the service position of the machine. If the empty roll holder 10 holds no empty roller, then the machine controller 40 commands the supply of an empty roller again by causing an alarm indicating device (or means) to produce an alarm signal at the step S22. The steps S20, S21 and S22 correspond to a checking means included in the preparing means. The checking means is connected with the indicating device (or means) as shown in FIG. 1.

The cloth roller replacement system of the second embodiment can also improve the efficiency of the weaving machines and make the full cloth rollers uniform by exchanging cloth rollers automatically without stopping the weaving operation. The replacement system of the second embodiment is arranged to call the empty roll carrier before the cloth roller becomes full, and each machine has the replacing mechanism. Therefore, the system of the second embodiment can carry out the replacement operation immediately, without waiting for a carrier, when the take-up quantity reaches an amount for replacement. The time for calling the empty roll carrier is adjustable, so that it is possible to make the most use of each empty cloth roller, and reduce the number of required empty cloth rollers. There is no need for calling the cloth carrier immediately after the replacement. Therefore, it is possible to cover many machines with only one cloth carrier.

Figure 30:
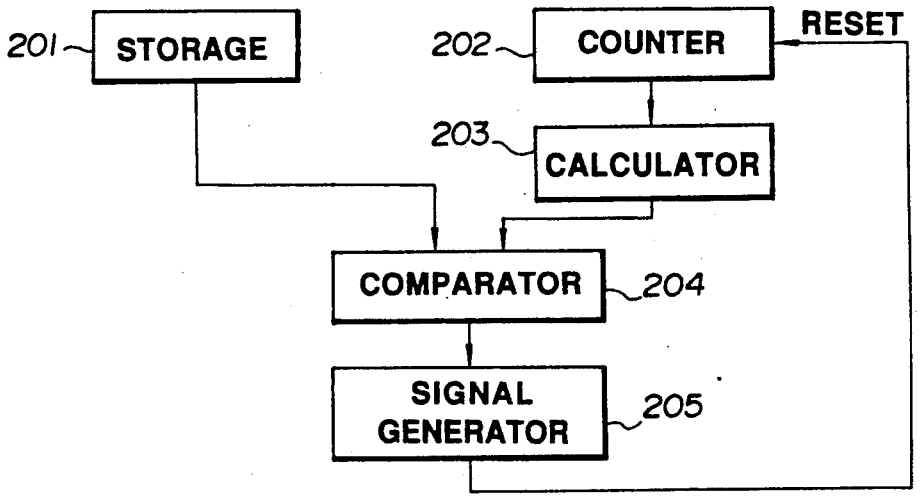
FIG. 30 is a block diagram showing a controller of a third embodiment of the invention.
Figure 31A:
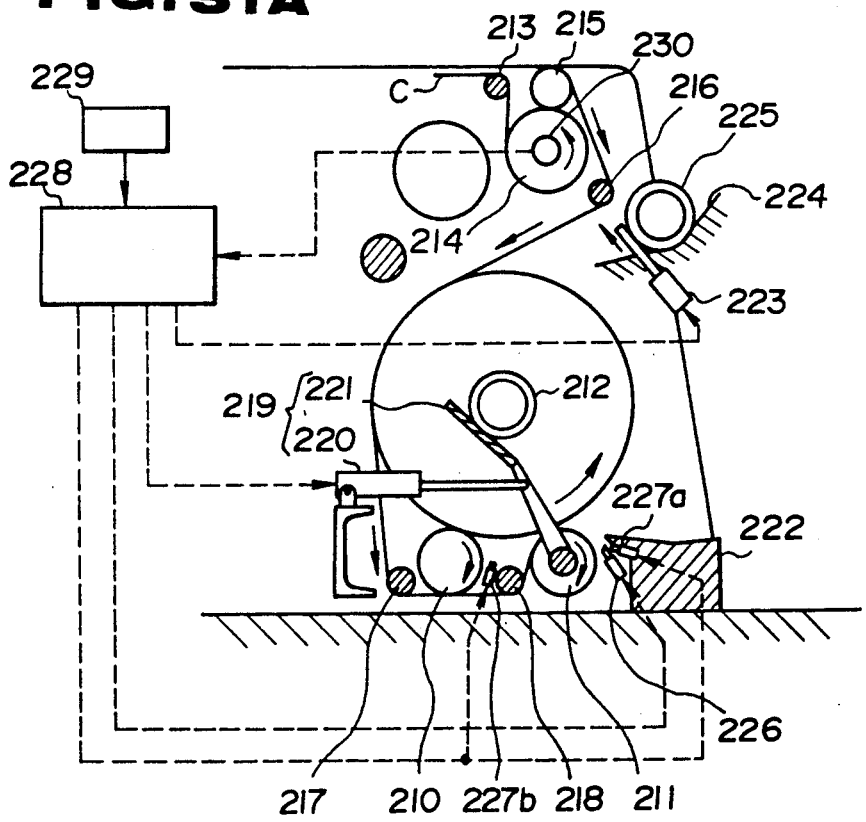
FIGS. 31A–31E are schematic views showing a replacement system of the third embodiment in various operating states.
Figure 31B:
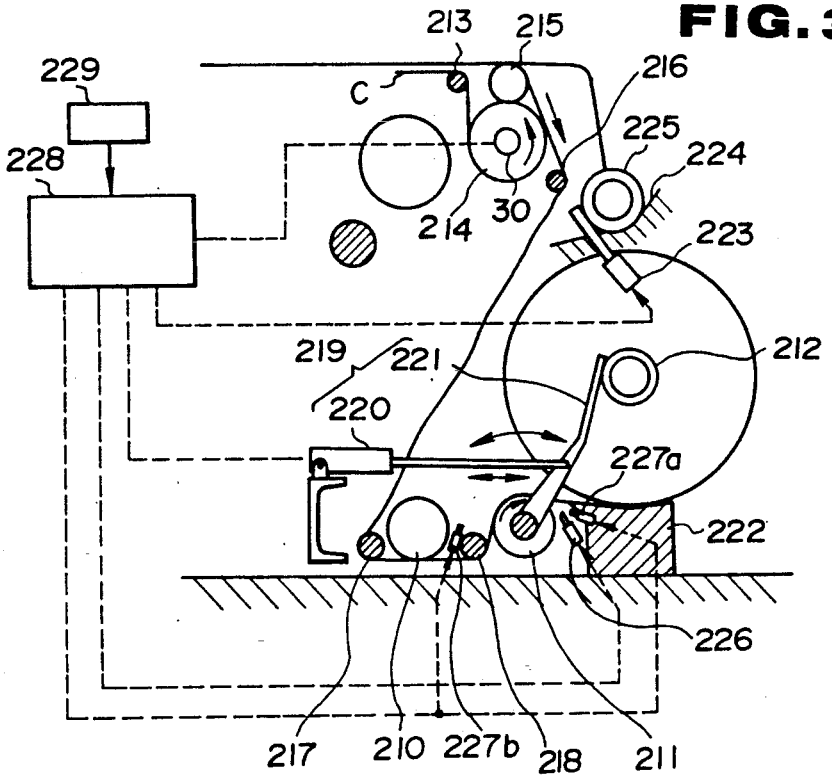
Figure 31C:
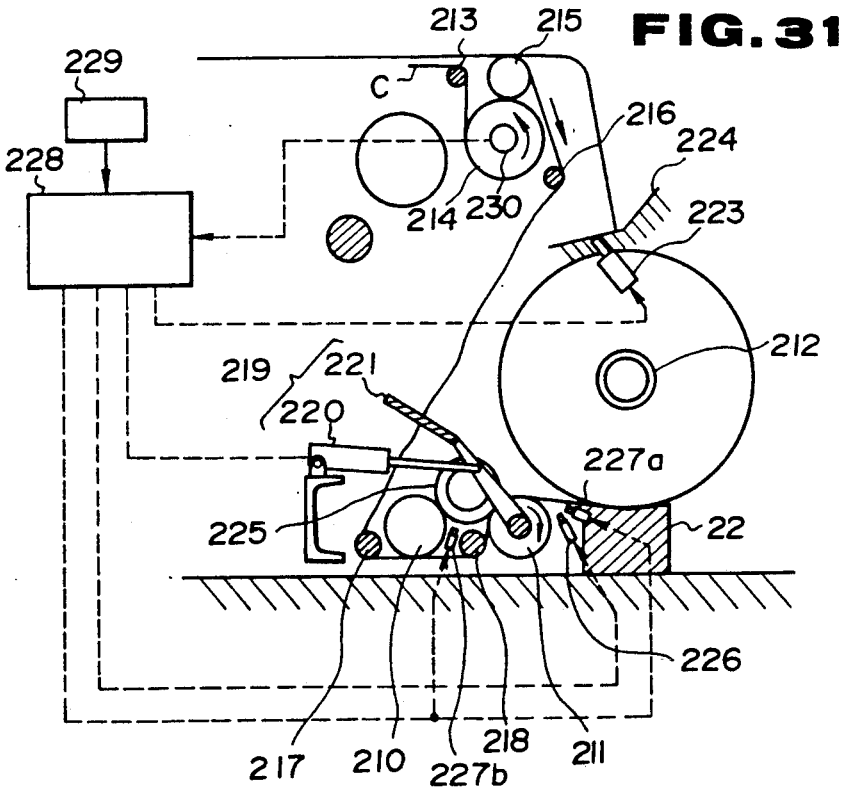
Figure 31D:
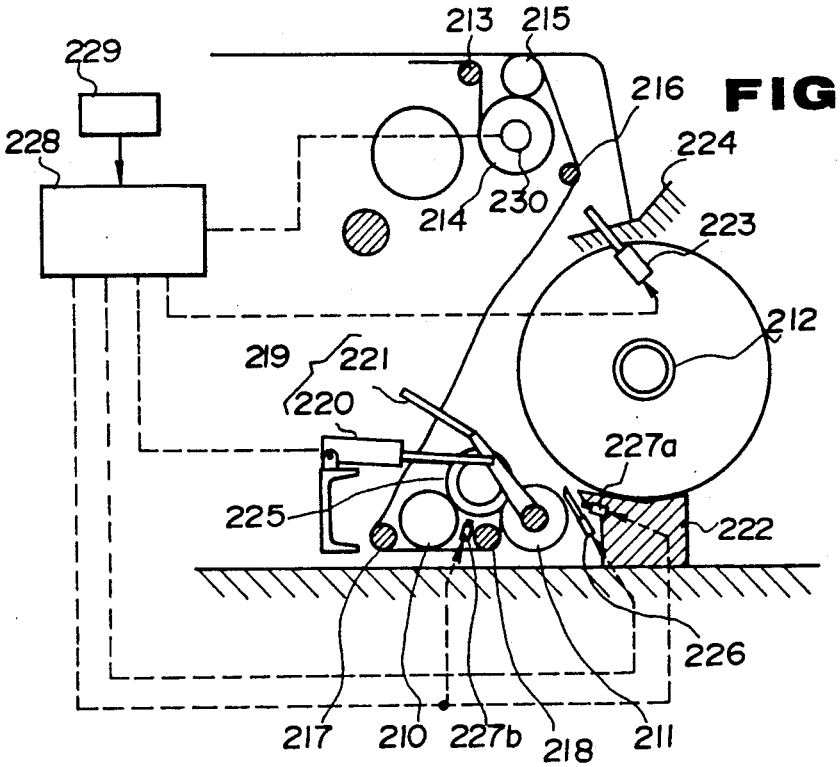
Figure 31E:
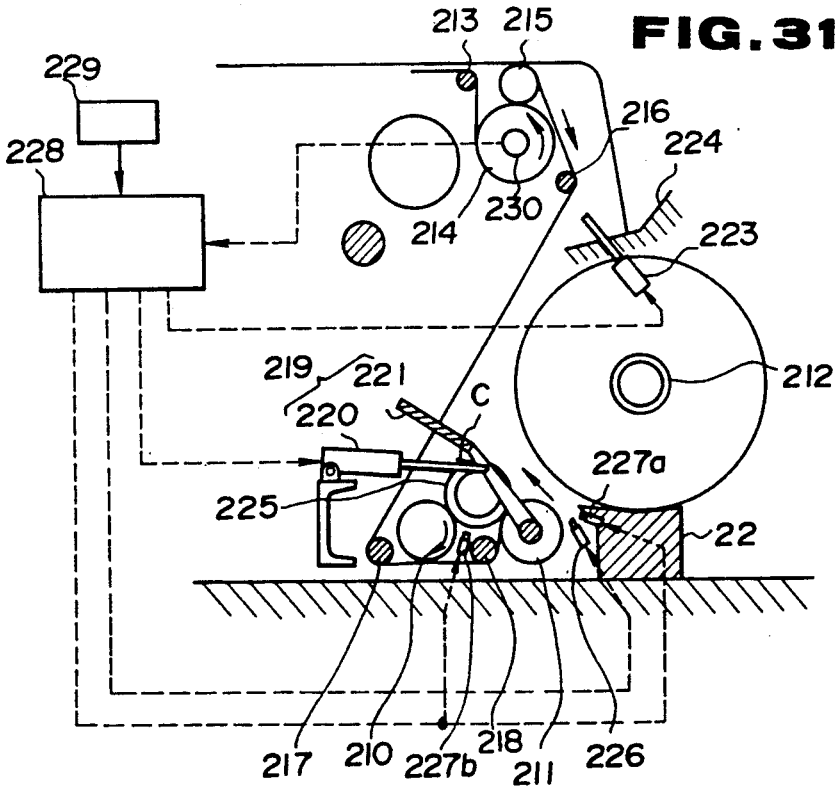
Figure 32:
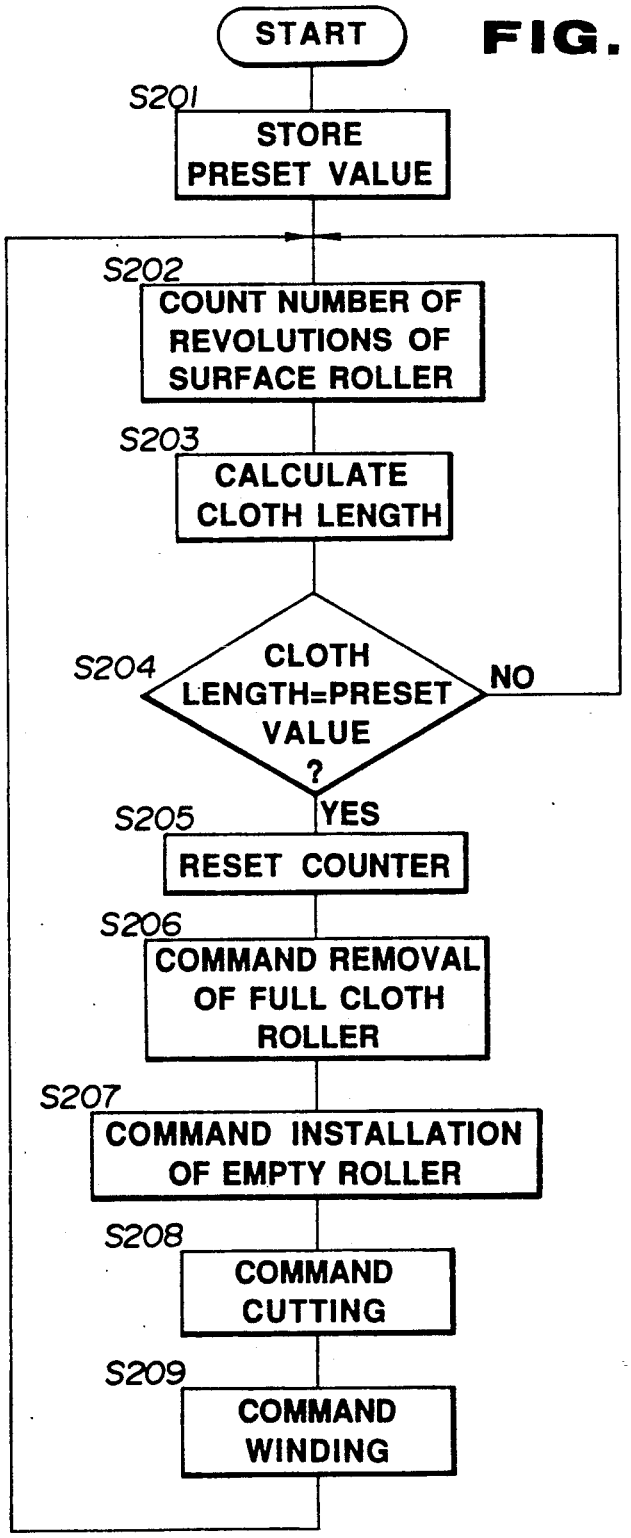
FIG. 32 is a flowchart showing a cloth roller replacement procedure of the third embodiment.

A third embodiment of the invention is shown in FIGS. 30–32. A cloth roller replacement system of the third embodiment includes a take-up quantity measuring system which can perform a reset action automatically.

A weaving machine shown in FIG. 31A has a fabric take-up mechanism similar to the take-up mechanism shown in FIGS. 14–29. The take-up mechanism shown in FIG. 31A includes a pair of surface drive support rolls 210 and 211 for supporting and driving a cloth roller 212. At least one of the support rolls 210 and 211 is driven by a motor (not shown). The woven cloth C is drawn from the cloth fell through a guide bar 213, a surface roller 214, a press roller 215, a guide bar 216, a guide bar 217, and a guide bar 218, to the cloth roller 212 rotating on the support rolls 210 and 211.

The weaving machine shown in FIG. 31A further includes a removing device (means) 219, a stopper 223, a cutting device (means) 226, and a winding device (means) 227. The removing device 219 includes actuators 220 and pushing levers 221 for removing the cloth roller 212 from the take-up position to a cloth seat 222. The cloth seat 222 serves as the receiving means for receiving a full cloth roller removed from the take-up position. The stopper 223 is movable between a hold position shown in FIG. 31A for holding an empty cloth roller 225 in an empty roll holder 224 of the machine, and a release position shown in FIG. 31C for releasing the empty roller 225. The holder 224 and the stopper 223 serve as the holding means. The cutting device 226 for cutting the woven cloth C includes a rotary blade which is driven by an air turbine, and which is moved from the left or right end of the woven cloth to the other end. The winding device 227 includes first and second air ejecting units 227*a* and 227*b* for winding a cut end of the cloth on an empty cloth roller as in the second embodiment.

The weaving machine further includes a machine controller 228 which is connected with a presetter 229 and a rotation sensor 230, for receiving input signals therefrom, and which is further connected with the removing device 219, the stopper 223, the cutting device 226, and the winding device 227 for controlling these devices by sending control signal. The presetter 229 of the third embodiment permits an operator to preset a full cloth roller value (first value) of the take-up quantity. The rotation sensor 230 has a component mounted on a drive shaft of the surface roller 214, and designed to detect rotation of the surface roller 214. The controller 228 controls each of the devices 219, 223, 226 and 227 in accordance with signals inputted from the presetter 229 and the rotation sensor 230.

As shown in FIG. 30, the controller 228 includes a storage section 201, a counter section 202, a calculator section 203, a comparator section 204, and a signal generator section 205. The storage section 201 is connected with the presetter 229, and arranged to store the preset value of the take-up quantity. The counter section 204 is connected with the rotation sensor 230, and arranged to count the number of revolutions of the surface roller 214. The calculator section 203 determines the current take-up quantity by using the count of the counter section. The comparator section 204 compares the measured take-up quantity determined by the calculator section 203 with the preset value stored in the storage section 201, and produces a comparator signal when the take-up quantity becomes equal to the preset value. In response to the comparator signal, the signal generator section 205 resets the counter section 202 by sending a rest signal. The controller 228 may be composed of a digital computer as a main component, or may be composed of analog devices. The presetter 229 and the storage section 201 serve as the presetting means. The counter and calculator sections 202 and 203 and the rotation sensor 230 serve as the measuring means. The generator section 205 serves as a resetting means.

FIGS. 31A–31E and 32 show a procedure of the third embodiment.

First, the operator presets the full cloth roller value of the take-up quantity with the presetter. Then, the machine controller 228 stores the preset full cloth roller value in the storage section 201 at a step S201 shown in FIG. 32.

When the weaving machine is started, the surface roller 214 is driven to take up the woven cloth C in cooperation with the cloth roller 214. Therefore, the rotation sensor 230 senses the rotational motion of the surface roller 214, and sends a signal to the controller 228. The counter 202 of the controller 228 receives the signal of the rotation sensor 230, and starts counting the number of revolutions of the surface roller 214 at a step S202. Then, at a step S203, the calculator section 203 of the controller 228 calculates the actual take-up quantity by using the count of the counter 202. In this embodiment, the take-up quantity is the length of a woven cloth taken up by the cloth roller 212.

At a step S204, the comparator section 204 of the controller 228 compares the actual cloth length with the preset full cloth roller value stored in the storage section 201. If the actual cloth length is smaller than the preset value, then the controller 228 repeats the steps S202 and S203. Therefore, the weaving machine continues the normal weaving operation, and the take-up mechanism takes up the woven cloth C, as shown in FIG. 31A.

When the actual cloth length becomes equal to the preset full cloth roller value, then the controller 228 proceeds from the step S204 to a step S205, and resets the counter 202. Therefore, the count of the counter 202 is made equal to zero. Almost simultaneously, the controller 228 produces a command signal to command the removing device 219 to remove the full cloth roller 212 from the take-up position of the machine (step S206). In response to this command signal, the removing device 219 transfers the full cloth roller 212 from the take-up position onto the cloth seat 222 by extending piston rods of the actuators 220 and rotating the pushing levers 221 about the axis of the support roll 211, as shown in FIG. 31B.

After the pushing levers 221 return to the original retracted position, the controller 228 produces a command signal to command the stopper 223 to install the empty cloth roller 25 in the take-up position (step S207). In response to this command signal, the stopper 223 moves to the release position, and release the empty roller 225 in the holder 224. Therefore, the empty cloth roller 225 falls to the take-up position on the support rolls 210 and 211, as shown in FIG. 31C.

After the installation of the empty roller 225 on the support rolls 210 and 211, the controller 228 produces a cutting command signal at a step S208, and command the cutting device 226 to cut the cloth C. In response to this cutting command signal, the cutting device 226 cuts the cloth C at a cutting position between the support roll 211 and the cloth seat 222, as shown in FIG. 31D.

After the cutting operation, the controller 228 produces a winding command signal at a step S209 and commands the winding device 227 to wind the cut end of the cloth C around the empty cloth roller 225 installed in the take-up position. In response to the winding command signal, the winding device 227 winds the cut end of the cloth C on the empty roller 225 by ejecting air jets, as shown in FIG. 31E.

After the step S209, the controller 228 returns to the step S202, and repeats the steps S202 and S203 until the empty cloth roller 225 becomes full. Before the empty cloth roller 225 becomes full, the machine controller 228 calls a carrier, and causes the carrier to transport the full cloth roller 212 from the cloth seat 222 to a predetermined station. In this case, the carrier of this embodiment brings another empty cloth roller and supplies it to the empty roll holder 224 of the machine.

In this way, the take-up quantity measuring system of the third embodiment is arranged to reset the counter automatically, and thereby eliminates the necessity for a troublesome manual resetting operation requiring an operator to come to the machine every cloth roller replacement period. The controller 228 of the third embodiment is arranged to reset the counter before the cloth roller replacement operation. However, the take-up quantity of the full cloth roller is held equal to the preset value because the counter was reset at the same timing in the previous cloth roller replacement operation. It is optional to design the controller 228 to produce the reset signal after the replacement operation. For example, a timer is used for delay the output of the reset signal by a predetermined time interval with respect to the output of the replacement command signal. Alternatively, it is possible to produce the reset signal simultaneously with any one of the steps S206–S209 of FIG. 32.

It is optional to perform a preparatory operation before the cloth roller becomes full. In this case, the machine controller 228 compares the measured take-up quantity with a preset smaller value which is smaller than the full cloth roller value, and commands the preparatory operation when the take-up quantity becomes equal to the preset smaller value. For example, the preparatory operation is an operation for confirming that an empty roller is held in the holder. Furthermore, it is optional to count the number of picks and to calculate the woven cloth length from the number of picks and the weft density.

A fourth embodiment of the invention is shown in FIGS. 33–40. A replacement system of the fourth embodiment includes an automatic cloth binding mechanism mounted on a carrier.

Figure 33:
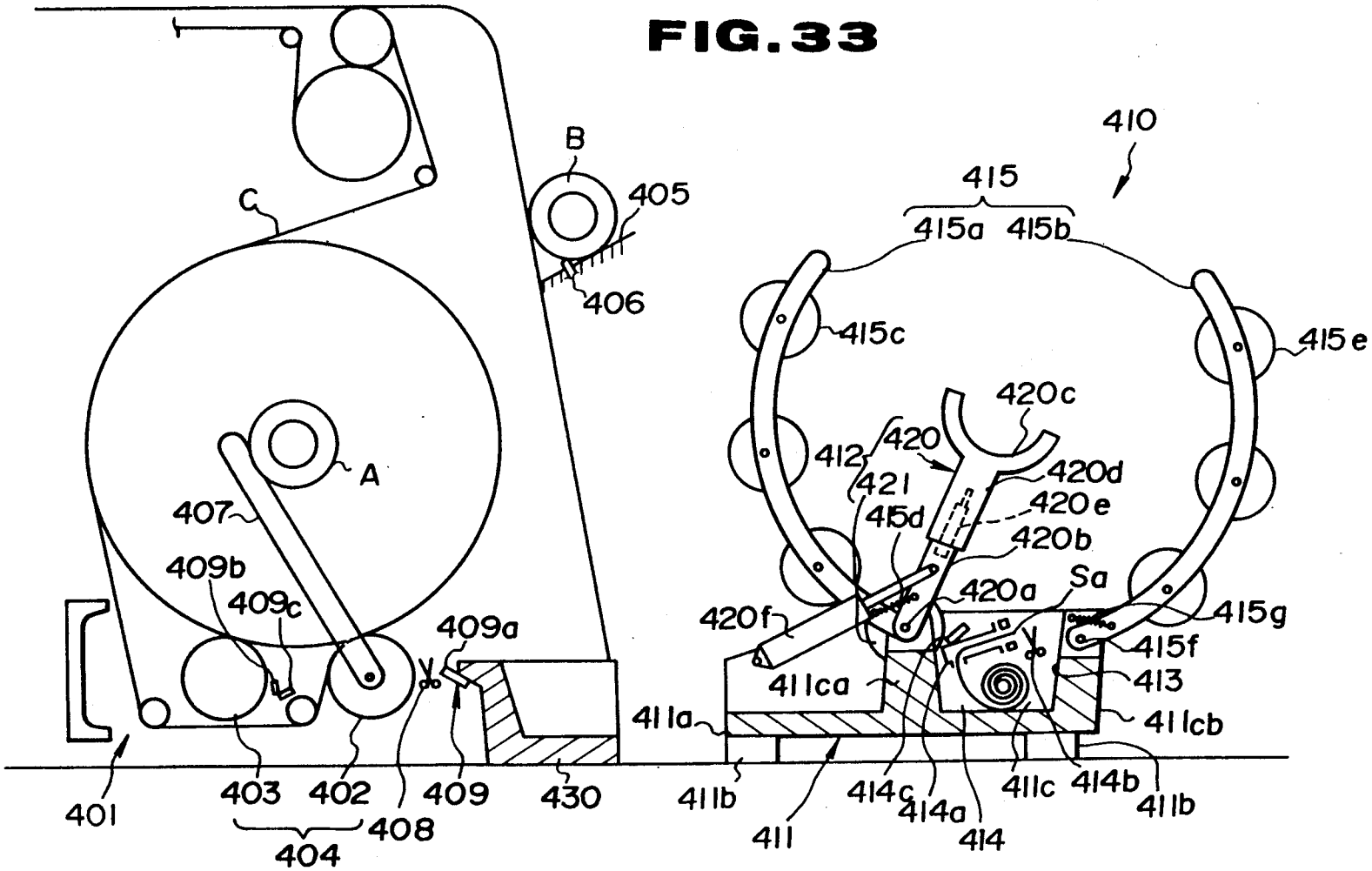
FIG. 33 is a schematic side elevation showing a cloth roller replacement system according to a fourth embodiment of the invention.
Figure 34:
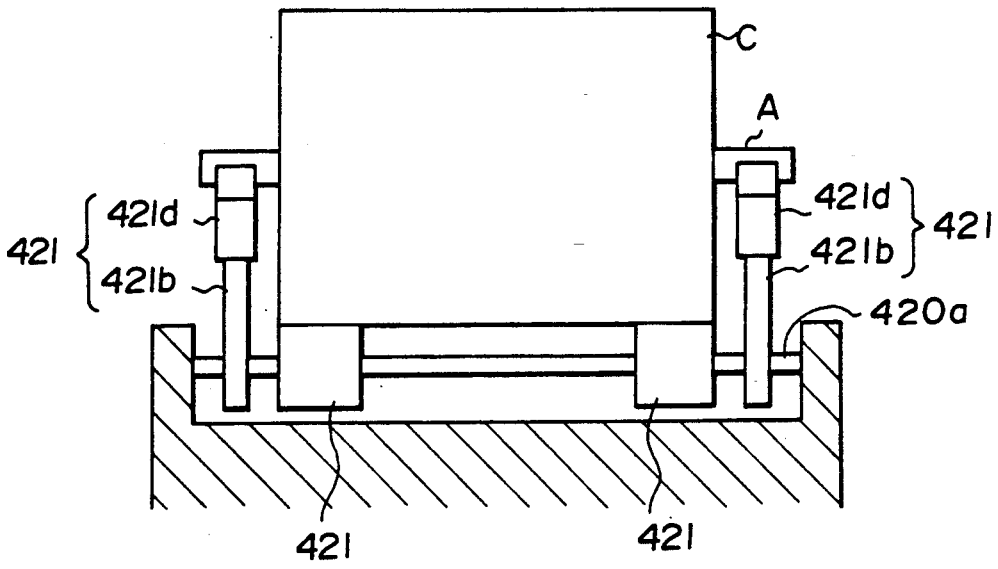
FIG. 34 is a front elevation showing a portion of a binding mechanism used in the fourth embodiment.

As shown in FIG. 33, a weaving machine (or each weaving machine) has a cloth roller replacing mechanism 401. The replacing mechanism 401 includes an empty roll holder 405 located above a drive support 404 consisting of support rolls 402 and 403, a stopper 406 for holding an empty cloth roller B in the holder 405, a pushing arm mechanism 407 for removing a cloth roller A forwardly from the take-up position, a cutting device 408 for cutting the woven cloth C, and a winding device 409 having first, second and third air nozzle units 409*a*, 409*b* and 409*c* for winding a cut end of the woven cloth around an empty roller B which is set on the support rolls 402 and 403 in place of the cloth roller A.

The cloth binding mechanism 410 of the fourth embodiment is mounted on a carrier 411, as shown in FIG. 33. The binding mechanism 410 has a rotating mechanism 412, a cloth end detector 413, a binder supplying mechanism 414, and a guide mechanism 415, which are all mounted on the carrier 411.

The carrier 411 has a carrier main body 411*a*, wheels 411*b*, a prime mover (not shown) and a steering mechanism. The carrier 411 of this embodiment is a self-propelled vehicle. The main body 411*a* has a depressed portion 411*c*.

Figure 36:
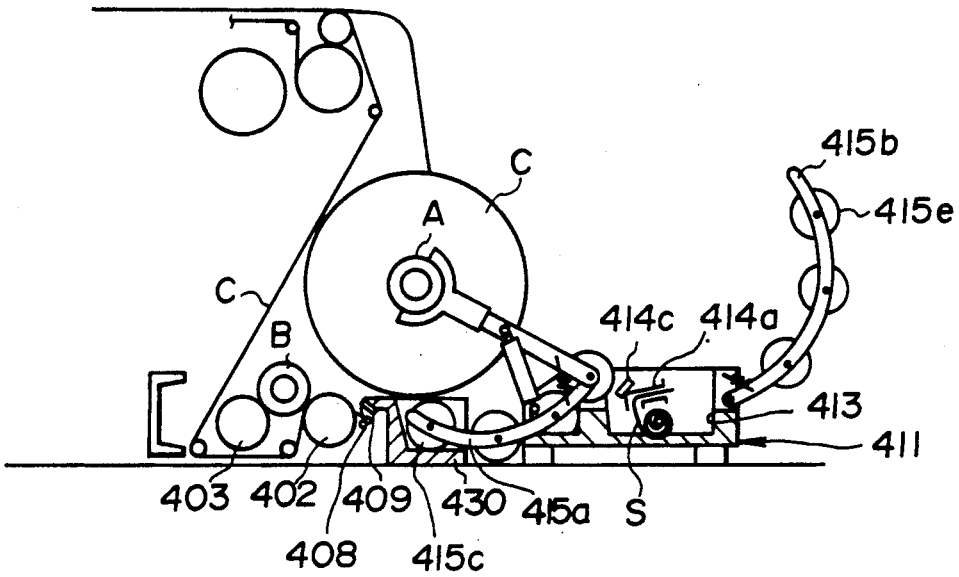
FIGS. 36–40 are schematic side views showing the system of the fourth embodiment in various operating states.
Figure 37:
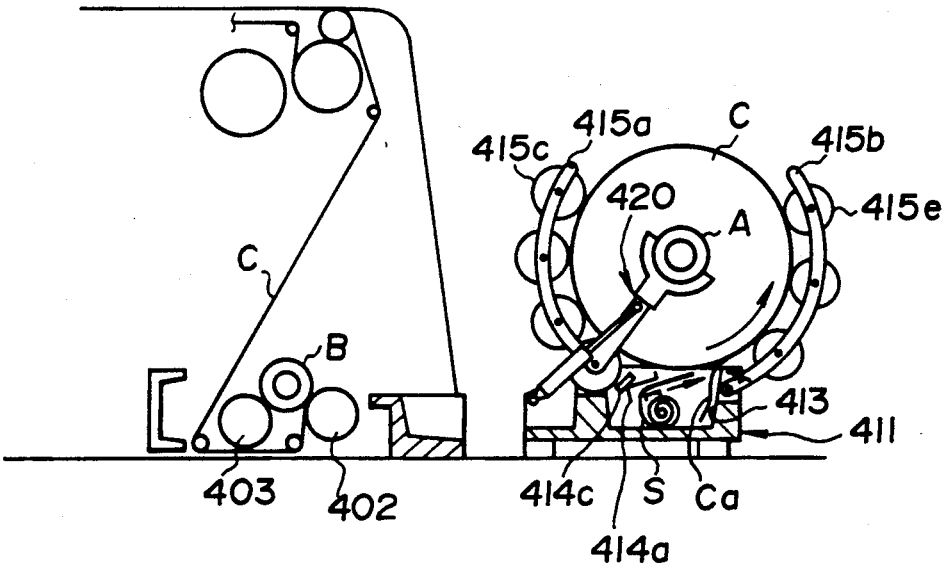
Figure 38:
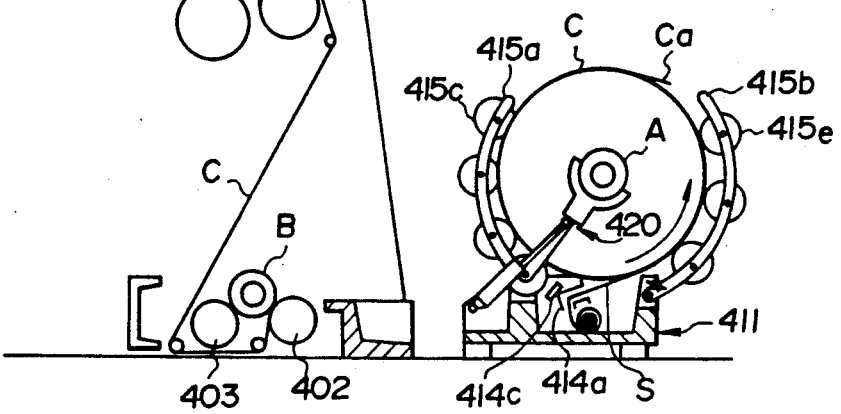
Figure 39:
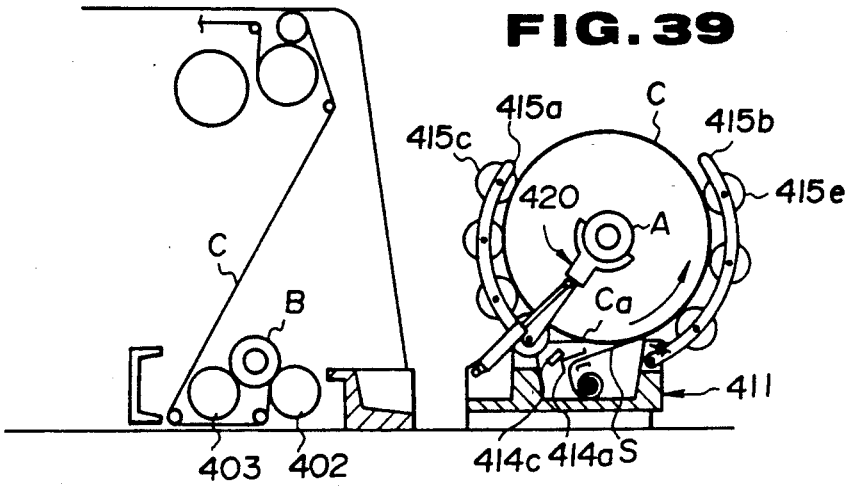
Figure 40:
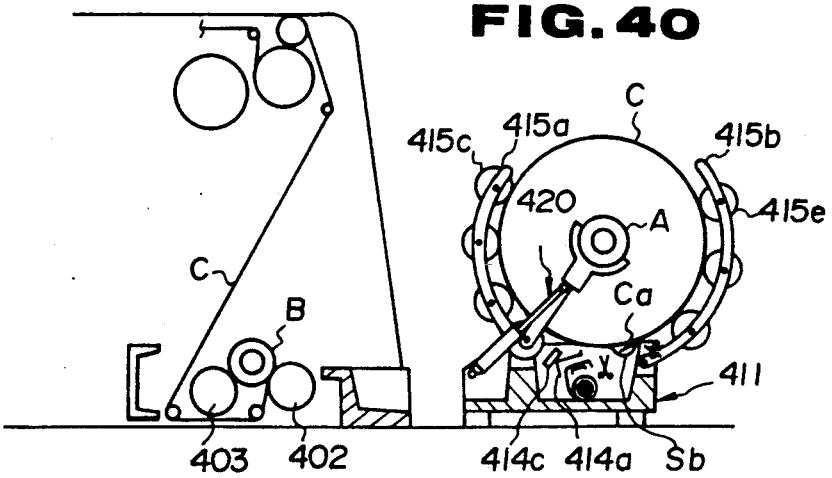

The rotating mechanism 412 includes transfer arms 420 for receiving the full cloth roller A from the machine, and drive rollers 421 for rotating the full cloth roller A on the carrier 411. The transfer arms 420 can support both ends of the full cloth roller A and transfer it from the machine to the carrier 411. Each transfer arm 420 has an inner member 420*b* pivotally supported at one end on a side wall of the main body 411*a* of the carrier 411 through a shaft 420*a*, and an outer member 420*d* having an upper end which is shaped like a semicircular arch to receive one end of the cloth roller. The inner member 420*b* is telescopically received in the outer member 420*d*, and a cylinder actuator 420*a* is formed in the arm 420 between the inner and outer members 420*b* and 420*d*. The actuator 420*e* can extend and shorten the transfer arm 420 by moving the outer member 420*d* axially relative to the inner member 420*b*. A cylinder actuator 420*f* is connected between each transfer arm 420 and the carrier main body 411*a*. The cylinder actuators 402*f* can cause the transfer arms 420 to swing between a receiving position shown in FIG. 36, and a binding position shown in FIG. 33. The drive rollers 421 are mounted on the shaft 420*a* extending in the widthwise direction of the cloth, and supporting the transfer arms 420. The drive rollers 421 are driven by a drive means mounted on the carrier 411, and cause the full cloth roller A to rotate on the carrier 411 in the counterclockwise direction as shown in FIG. 37. In this state, the drive rollers 421 are in contact with the cloth C of the full cloth roller A.

The clock end detector 413 is mounted on a side wall 411*cb* of the carrier main body 411*a*. The depressed portion 411*c* is formed between the side wall 411*ca* and the side wall 411*cb*. The second side wall 411*cb* is remoter from the weaving machine than the first side wall 411*ca* when the carrier 411 is placed correctly in the service position of the weaving machine, as shown in FIG. 33. When the full cloth roller A is rotated on the carrier 411, a cut end Ca of the cloth reaches a state in which the cut end Ca hands down within the depressed portion 411*c* near the cloth end detector 413, as shown in FIG. 37. For example, the cloth end detector 413 may comprise a component for emitting light toward the cloth end Ca, and a component for receiving light reflected from the cloth end Ca handing near the detector 413. When the cloth end detector 413 detects the existence of the cloth end Ca, then the detector 413 produces a cloth end detection signal.

Figure 35:
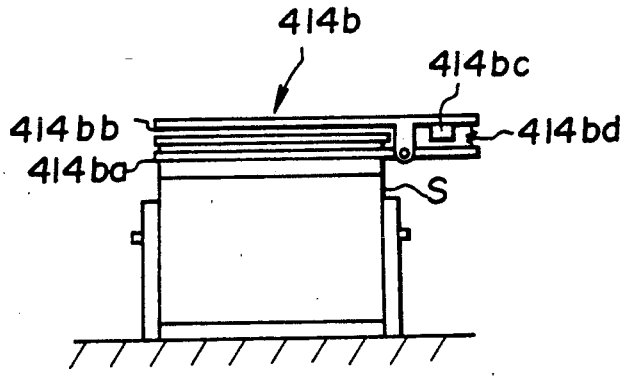
FIG. 35 is a front elevation showing a binder supplying mechanism used in the fourth embodiment.

The binder supplying mechanism 414 supplies a binder S in response to the cut end detection signal of the cloth end detector 413. In this embodiment, the binder S is in the form of a strip or roll of film made of polyvinylidene chloride (which is available under the trademark "Saranwrap", ASAHI CHEMICAL INDUSTRY CO., LTD (Asahi Kasei Kogyo). The binder supplying mechanism 414 includes a holder for holding the roll of binder film S, a first air nozzle 414*a*, a binder cutter 414*b*, a second air nozzle 414*c*. In response to the cloth end detection signal, the first nozzle 414*a* ejects air, and blows a forward end portion Sa of the binder film S into the corner between the hanging cloth end Ca and the bulk of cloth C rolled up on the full cloth roller A. Therefore, the forward end Sa of the binder film S is caught under the cloth end Ca, and rotates around the cloth C with rotation of the cloth roller A. Thus, the binder film S encircles the cloth C. When one round movement of the forward end Sa of the binder film S is completed, the cutting device 414 is actuated to cut the binder film S drawn out from the air nozzle 414*a*. A trailing cut end Sb of the binder film S is overlaid on, and adhered to, the binder film S around the cloth C. As shown in FIG. 35, the cutting device 414*b* of this embodiment has a fixed blade 414*ba*, a movable blade 414*bb*, a solenoid 414*bc* and a return spring 414*bd*. The solenoid 414*bc* causes the movable blade 414*bb* to more relative to the fixed blade 414*ba* like scissors to cut the binder film S. The spring 414*bd* is arranged to return the movable blade 414*bb* to the original position. The thus-constructed cutting device 414*b* of this embodiment is of an electromagnetic self-returning type. The second air nozzle 414*c* is provided on a portion of the first nozzle 414*a* near the drive rollers 421. The second air nozzle 414*c* ejects air and prevents the cut end Ca of the cloth C from hanging down after passage through the drive rollers 421. Therefore, the cut end Ca of the cloth C holds the forward end Sa of the binder film S between the bulk roll of the cloth C and the cut end portion Ca.

The guide mechanism 415 has a first arm structure 415*a* and a second arm structure 415*b*. Each of the arm structures 415*a* and 415*b* is shaped like semicircular arch. A plurality of rollers 415*c* are rotatably mounted on the first arm structure 415*a*. A plurality of rollers 415*e* are rotatably mounted on the second arm structure 415*b*. The first and second arm structures 415*a* and 415*b* are designed to hold the full cloth roller A, as shown in FIG. 37, and to press the cut end Ca of the cloth C radially inwardly so as to prevent the forward end Sa of the binder film S from slipping off. The lower end of the first arm structure 415*a* is swingably mounted on the shaft 420*a* of the transfer arm 420. At least one spring 415*d* is disposed between the first guide arm structure 415*a* and the transfer arm structure 420. The first guide arm structure 415*a* moves between an open position shown in FIG. 36 and a closed position shown in FIG. 33, with movement of the transfer arm structure 420 between the receiving position and the binding position. The lower end of the second guide arm structure 415*b* is swingably mounted through a shaft 415*f* on the upper part of the side wall 411*cb* of the carrier main body 411*a*. At least one spring 415*g* is disposed between the second guide arm structure 415*b* and the side wall 411*cb*. In the state shown in FIG. 33, the first and second arm structures 415*a* and 415*b* confront each other and form a cylindrical space for holding the full cloth roller there between.

When the take-up quantity of the cloth roller A reaches a predetermined amount, the carrier 411 is requested to come to the service position of the machine. The carrier 411 arrives at the service position as shown in FIG. 33, and moves its transfer arm structure 420 from the binding position shown in FIG. 33 to the receiving position shown in FIG. 36 by using the cylinder actuators 420*e* and 420*f*. In accordance with this movement of the transfer arm structure 420, the first guide arm structure 415*a* moves from the closed position shown in FIG. 33 to the open position shown in FIG. 36. In the open position, the foremost roller 415*c* rests on a lower side frame member 430 of the machine, as shown in FIG. 36.

When the take-up quantity reaches the full cloth roller amount, the full cloth roller A is removed from the take-up position of the machine by the pushing arm structure 407 of the machine, and placed on the frame member 430 and the foremost roller 415*c* of the first guide arm structure 415*a*. At the same time, the receiving portions of the transfer arm structure 420 hold both ends of the full cloth roller A, as shown in FIG. 36. Then, the stopper 406 of the machine releases the empty cloth roller B in the holder 405, and the empty roller B is installed on the support rolls 402 and 403, as shown in FIG. 36. After that, the cloth cutting device 408 mounted on the machine cuts the cloth C between the support roll 402 and the full cloth roller A, and a cut end of the cloth is wound around the empty cloth roller B by the winding device 409. The machine continues the weaving operation, and the woven cloth is take up to the empty cloth roller B.

After the cloth cutting operation, the transfer arm structure 420 moves from the receiving position to the winding position with the cylinder actuators 420*e* and 420*f*, and mounts the full cloth roller A on the carrier 411. This operation is performed in parallel to the winding operation of the winding device 409. The first guide arm structure 415*a* moves from the open position to the closed position together with the transfer arm structure 420, as shown in FIG. 37. In the state shown in FIG. 37, the full cloth roller A is held between the first and second guide arm structures 415*a* and 415*b*, and the rollers 415*c* and 415*e* are resiliently held in contact with the outside cylindrical surface of the cloth C rolled on the roller A, by the springs 415*d* and 415*g*. The drive rollers 421 are also brought into contact with the cloth C of the roller A. At the same time, or after the contact between the drive rollers 421 and the cloth C is made, the drive means starts driving the drive rollers 421, and the full cloth roller A starts rotating in the counterclockwise direction as shown in FIG. 37 while the full cloth roller A remains supported by the transfer arm structures 420 and confined between the first and second guide arm structures 415*a* and 415*b*. With the rotation of the full cloth roller A, the cut end Ca of the cloth C of the roller A passes through the drive rollers 421, the second nozzle 414*c*, the first nozzle 414*a*, and the cutting device 414*b*, and finally falls in the depressed portion 411*c*. Therefore, the cloth end detector 413 is covered by the hanging cloth end Ca and produces the cloth end detection signal. In response to this detection signal, the first nozzle 414*a* discharges air, and blows the forward end Sa of the binder film S into the corner between the hanging cloth end Ca and the bulk of the cloth C. The first nozzle 414*a* continues the air ejection until the forward end Sa of the binder film S is pressed by the lowermost roller 415*e* of the second guide arm structure 415*b*. Thus, the forward end Sa of the binder film S is pressed between the cloth end Ca and the bulk of the cloth C by the rollers 415*e* and 415*c*, and rotated with the cloth roller A. The binder film S is drawn out continuously from the binder supplying mechanism. When the forward end Sa of the binder film S passes through the drive rollers 421, the second nozzle 414*c* ejects air upwardly, and blows the cloth end Ca upwardly.

After the cloth end Ca passes the first nozzle 414*a*, the trailing portion of the binder film S covers the cloth end Ca and adheres to the binder film already rolled up on the cloth roller A because of the adhesive property of the binder film S. Then, the binder cutting device 414*b* cuts the binder film S near the first nozzle 414*a*, and the carrier 411 stops the rotating of the drive rollers 421. In this way, the full cloth roller A is encircled and binded by the binder film by the binding mechanism 410.

Then, the carrier 411 carries the full cloth roller A to a storehouse. The carrier 411 of this embodiment can perform the binding operation while the carrier 411 is in motion. Therefore, it is possible to command the carrier 411 to start moving toward the storehouse, and to perform the binding operation during the travel.

A fifth embodiment of the invention is shown in FIGS. 41–44. In this embodiment, a binding mechanism 410A is provided on the weaving machine's side.

Figure 41:
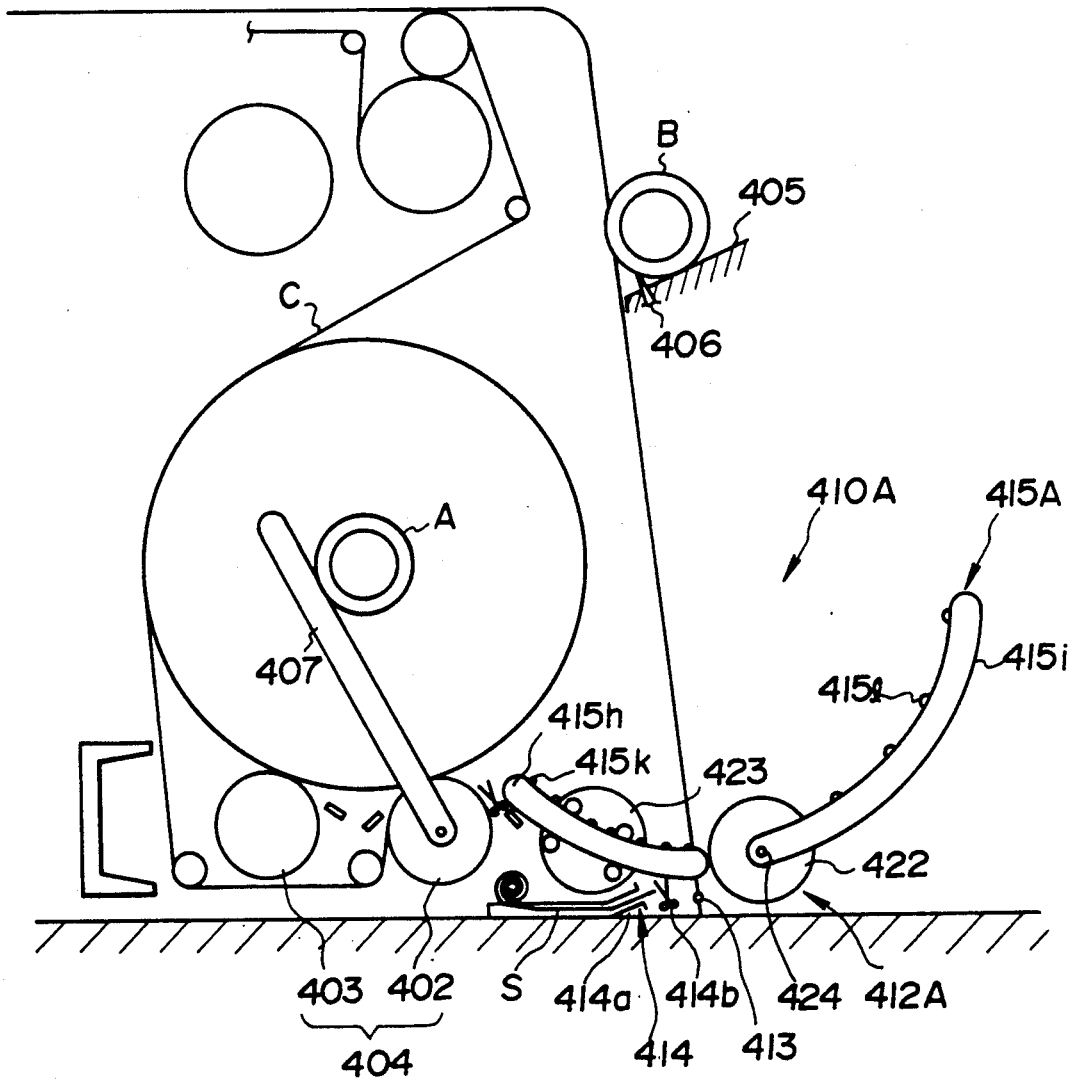
FIG. 41 is a side elevation showing a replacement system according to a fifth embodiment of the invention.

As shown in FIG. 41, a binding mechanism 410A is disposed in front of the drive support 404 of the weaving machine. The binding mechanism 410A includes a rotating mechanism 412A, a cloth end detector 413, a binder supplying mechanism 414, and a guide mechanism 415A.

The rotating mechanism 412A has front and rear rollers 422 and 423. The front rollers 422 are rotatably mounted on shafts 424, and the rear rollers 423 are rotatably mounted on shafts 425. In this embodiment, the rear rollers 423 are drivingly connected with a drive means.

Figure 42:
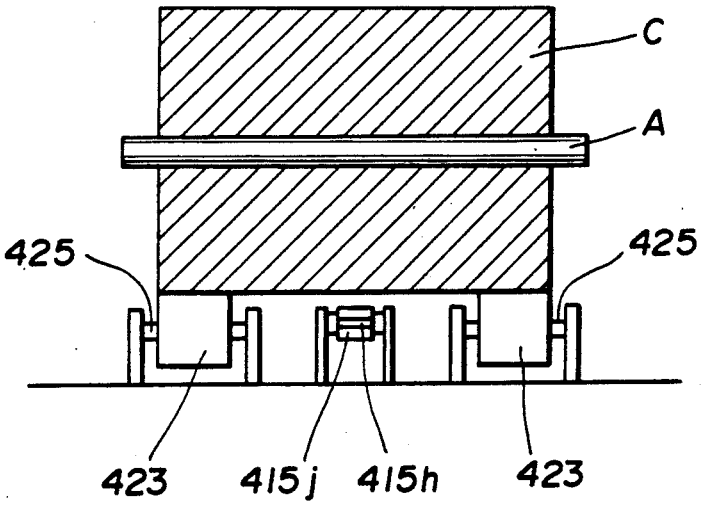
FIG. 42 is a front elevation showing a portion of a binding mechanism used in the fifth embodiment.
Figure 43:
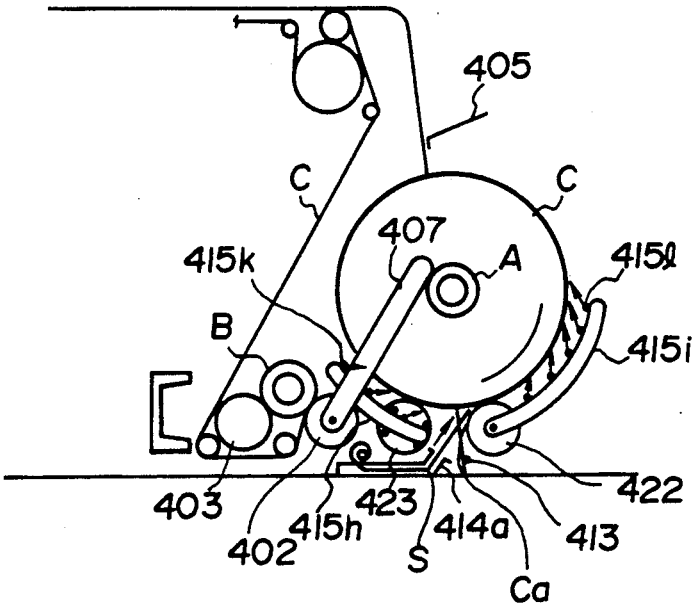
FIGS. 43 and 44 are side views showing the system of the fifth embodiment in various operating states.

The guide mechanism 415A has a first guide nozzle member 415*h* and a second guide nozzle member 415*i*. Each nozzle member is shaped like a circular arc, as shown in FIG. 41. As shown in FIG. 42, the first guide nozzle member 415*h* is connected with a shift mechanism 415*j* disposed between the rear drive rollers 423. The shift mechanism 415*j* can cause the first guide nozzle member 415*h* to move between a withdrawal position shown in FIGS. 41, 44, and a guide position shown in FIG. 43. The second guide nozzle member 415*i* is fixedly mounted between the front drive rollers 422. In the state shown in FIG. 43 in which the full cloth roller A is placed on the drive rollers 422 and 423, the first and second guide nozzle members 415*h* and 415*i* are not in contact with the full cloth roller A, but spaced at a predetermined small distance from the outside surface of the full cloth roller A. Each of the guide nozzle members 415*h* and 415*i* extends circumferentially around the full cloth roller A while keeping a limited distance from the cloth of the full cloth roller A. The first guide nozzle member 415*h* has a plurality of spout holes 415*k*, and the second guide nozzle member 415*i* has a plurality of spout holes 415*l*. The spout holes 415*k* and 415*l* can discharge air obliquely toward the outside surface of the full cloth roller A, as shown in FIG. 43. The direction of air jet ejected from each spout hole is intermediate between the rotational direction (or the tangential direction) of the full cloth roller A and the radial inward direction pointing toward the axis of the full cloth roller A. The air jets ejected from the spout holes 415*k* and 415*l* act to press the trailing end of the cloth of the cloth roller A toward the axis, and form an air stream flowing around the full cloth roller in the rotational direction of the roller A.

In this embodiment, the cloth roller replacement mechanism of the weaving machine transfers the full cloth roller A from the tape-up position to a binding position on the drive rollers 422 and 423, installs the empty cloth roller B on the take-up position, cuts the cloth C at the cutting position between the rollers 402 and 423, and winds the leading cut end of the cloth of the machine around the empty cloth roller B. After the cloth C is cut, the drive rollers 423 start rotating the full cloth roller A on the rollers 422 and 423. Therefore, the trailing cut end Ca of the cloth of the full cloth roller A passes through the rear rollers 423, the air nozzle 414*a* and the cutting device 414*b*, and reaches a state in which the cut cloth end Ca hangs down from the rollers 422. The cloth end detector 413 detects the hanging cloth end Ca and produces the cloth end detection signal. In response to this detection signal, the air nozzle 414*a* of the binder supplying mechanism 414 discharges air, and blows the forward end of the binder films such as the saran resin film into the corner between the hanging cloth end Ca and the bulk roll of the full cloth roller A. On the other hand, the shift mechanism 415*j* moves the first guide nozzle member 415*h* from the withdrawal position to the guide position, and the spout holes 415*k* and 414*l* of the first and second nozzle members 415*h* and 415*i* eject air toward the full cloth roller A. Therefore, the forward end Sa of the binder film S is pressed under the training cloth end Ca by the air jets from the spout holes 415*k* and 415*l*, and the binder film 8 advances around the full cloth roller A while being pressed by the air jets.

Figure 44:
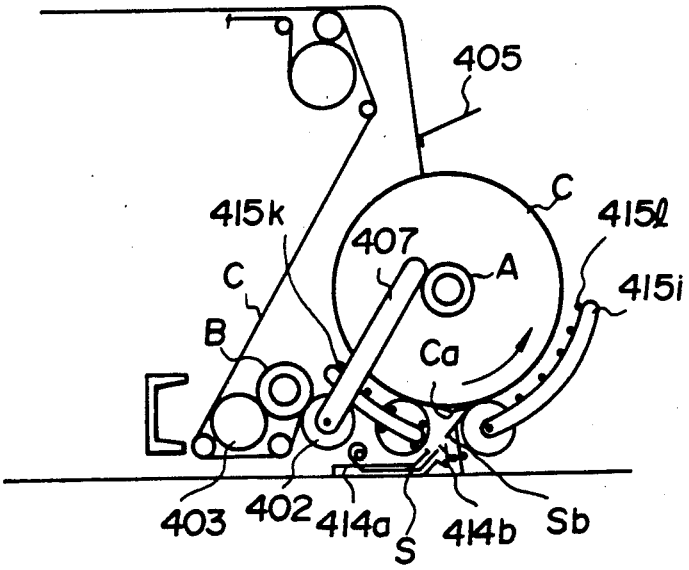

When the trailing cloth end Ca passes through the rear rollers 423 as shown in FIG. 44, portions of the binder film S overlap each other and stick together by the adhesive force of the binder film. Then, the binder cutting device 414*b* cuts the binder film S near the air nozzle 414*a*, and the drive mechanism stops driving the full cloth roller A. In this way, the trailing end of the cloth C is fastened by the binder film.

After the binding operation, the full cloth roller A is carried away to the storehouse. In this embodiment, it is not necessary to carry the full cloth roller A away from the machine immediately after the binding operation, but it is possible to retain the full cloth roller A on the binding mechanism until the take-up quantity of the empty cloth roller B reaches a certain amount.

In the fourth and fifth embodiments, it is possible to attach a card (or label) to the binder film S to indicate the kind of the cloth and other information. Furthermore, it is possible to fasten the trailing end of the cloth C with an adhesive binder such as an adhesive tape, without encircling the full cloth roller.

The binding mechanisms of the fourth and fifth embodiments can bind the full cloth roller automatically at or near the weaving machine. Therefore, it is possible to prevent the trailing cloth end of the full cloth roller from being made dirty by a floor or entangled with a wheel of the carrier.

A sixth embodiment of the invention is shown in FIGS. 45A–52C. The system of the sixth embodiment is a cloth roller transportation system including at least one pair of weaving machines.

Figure 45A:
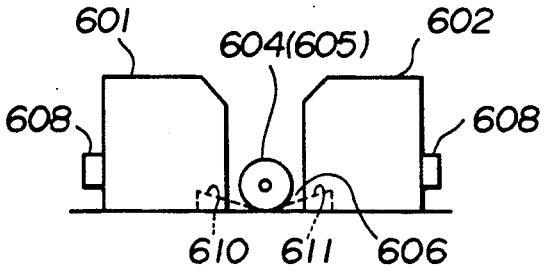
FIG. 45A is a schematic view showing a system according to a sixth embodiment of the invention.
Figure 45B:
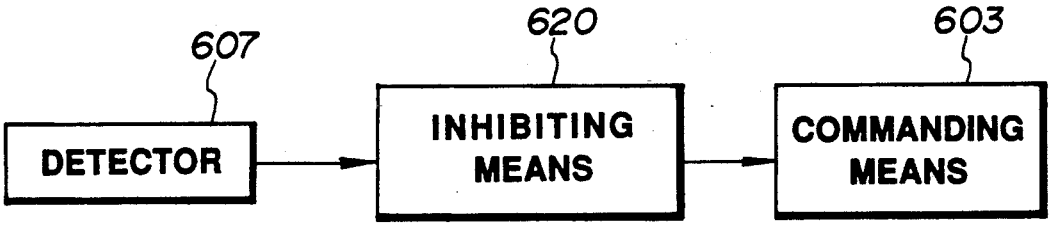
FIG. 45B is a block diagram showing an inhibiting means used in the sixth embodiment.
Figure 55:
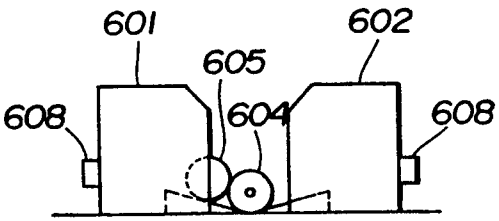
FIG. 55 is a view for illustrating an undesired collision of two full cloth rollers.

As shown in FIG. 45A, the cloth roller transportation system of the sixth embodiment includes at least one pair of first and second weaving machines 601 and 602 which are placed face to face, and a cloth seat 606 placed between the first and second weaving machines 601 and 602. The cloth seat 606 is arranged to receive a full cloth roller from either of the first and second machines 601 and 602. The cloth seat 606 is common to the first and second machines 601 and 602. The cloth seat 606 serves as a common receiving means. A photoelectric cloth roller detector (sensor) 607 is disposed in the cloth seat 606, and arranged to detect the existance of a cloth roller on the cloth seat 606. The detector 607 serves as a detecting means. The photoelectric detector 607 is connected with an inhibiting means (device) 620. The photoelectric detector (sensor) 607 produces a non-vacancy signal when the cloth seat 606 is occupied by a cloth roller 604 or 605 received from the first or second weaving machines 601 or 602, and a vacancy signal when the cloth seat 606 is empty. Each machine has a commanding means 603 for commanding the cloth roller replacement. When the cloth seat 606 is occupied by the full cloth roller 604 or 605 removed from the take-up position of one of the machines 601 and 602, then the detector 607 produces the non-vacancy signal, and the inhibiting means 620 responds to the non-vacancy signal and inhibits the commanding means 603 of the other of the machines 601 and 602 from removing the full cloth roller from its take-up position. In this way, the inhibiting means 620 prevents the full cloth rollers 604 and 605 from being removed simultaneously, and from colliding with each other, as shown in FIG. 55.

The cloth seat 606 has a first slope member 110 having a top surface sloping down from the first weaving machine 601 to the middle of the cloth seat 606, and a second slope member 611 having a top surface sloping down from the second weaving machine 602 to the middle of the cloth seat 606. Therefore, the cloth seat 606 has V-shaped depression formed by the sloping top surfaces of the first and second slope members 610 and 611, as shown in FIG. 45A. The detector 607 is disposed in the deepest middle of the cloth seat 606.

Figure 48:
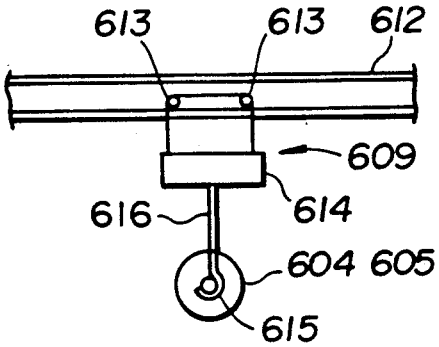
FIG. 48 is a front view showing a carrier used in the sixth embodiment.

The transportation system of the sixth embodiment further includes a carrying means which comprises at least one rail 612 fixed to the ceiling of a factory, as shown in FIG. 48, and at least one overhead carrier 609 movable along the rail 612. The overhead carrier 609 has a main body 614 suspended from the rail 612 through wheels 613, and a hook member 615 suspended from the main body 614 by a chain 616. The hook member 615 can catch both ends of a full cloth roller, and move up and down.

Figure 49:
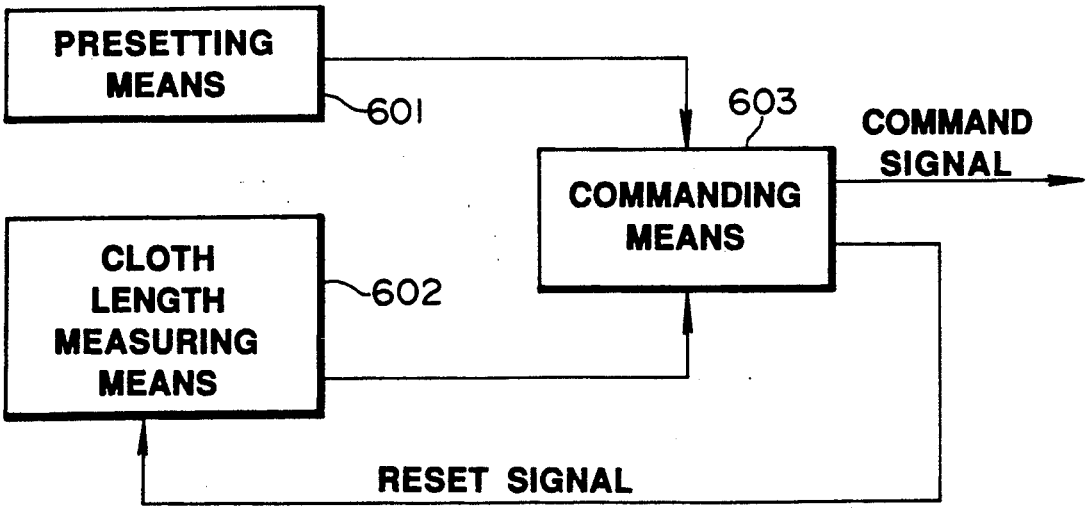
FIG. 49 is a block diagram showing a controller of the sixth embodiment.
Figure 46:
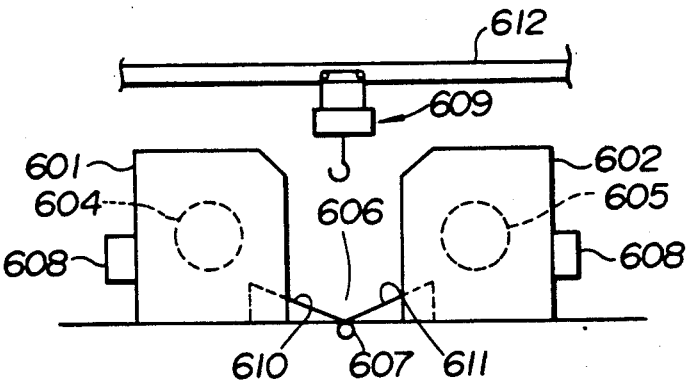
FIG. 46 is a front view showing an arrangement of first and second weaving machines of the sixth embodiment.
Figure 47:
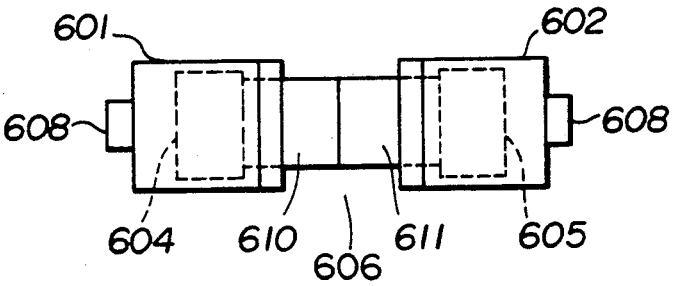
FIG. 47 is a plan view showing the arrangement of the first and second weaving machines.

As shown in FIG. 49, the commanding means 603 of each machine is connected with a cloth length presetting means 601, and a means 602 for measuring an actual woven cloth length, and arranged to produce a reset signal to make the measured cloth length equal to zero when the measured cloth length becomes equal to the preset value.

Figure 50A:
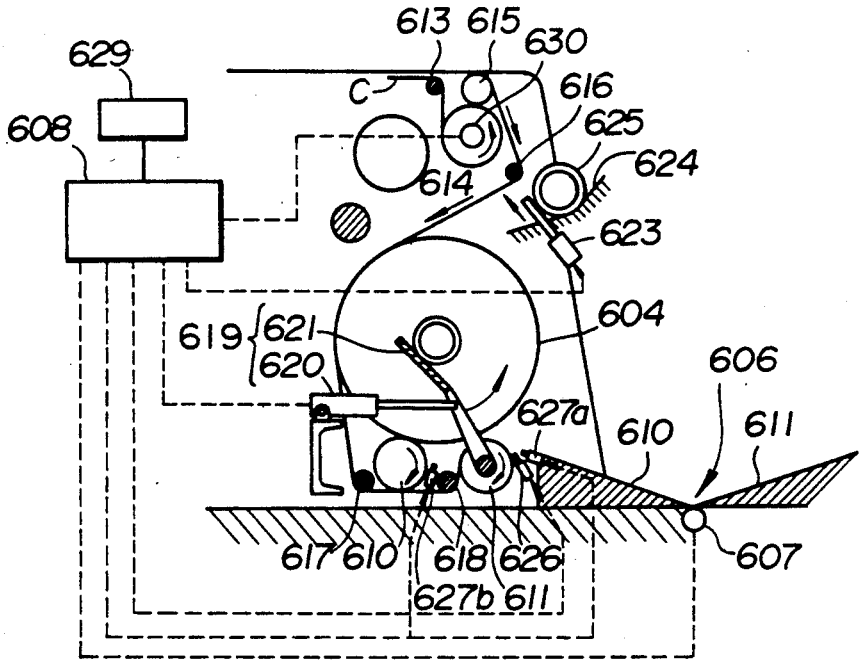
FIGS. 50A–50E are schematic views showing the system of the sixth embodiment in various operating states.
Figure 50B:
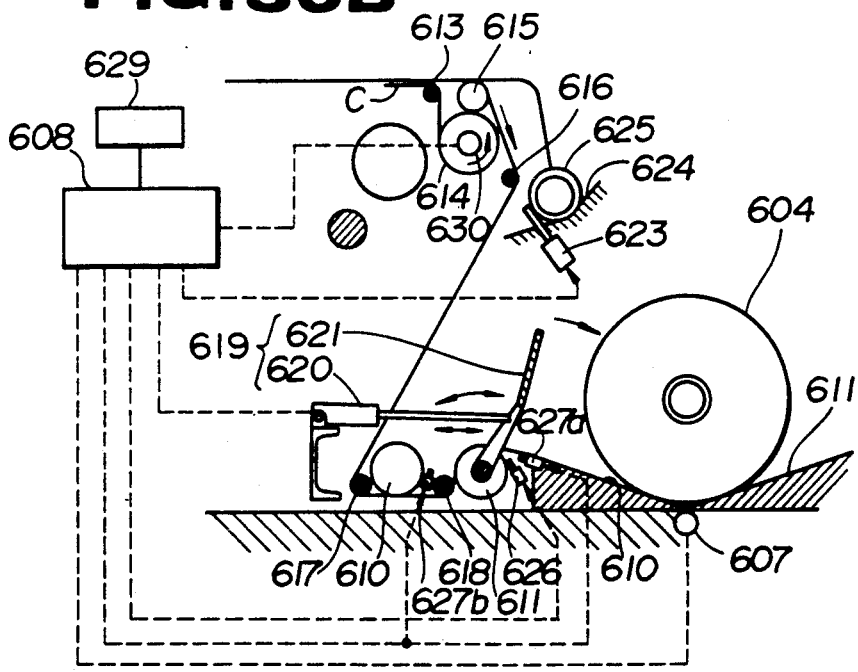

In this embodiment, the first and second weaving machines 601 and 602 are substantially identical in construction to each other. FIG. 50A shows only the first machine 601. As shown in FIG. 50A, the machine 601 has a surface drive type support rollers 610 and 611 for supporting and driving the cloth roller 604. At least one of the support rollers 610 and 611 is driven by a motor. The woven cloth C advances from the cloth fell through a guide bar 613, a surface roller 614, a press roller 615, a guide bar 616, a guide bar 617 and a guide bar 618, to the cloth roller 604.

A removing mechanism 619 of the machine 601 includes left and right actuators 620 and left and right pushing levers 621 for pushing the left and right ends of the cloth roller 604, and removing the cloth roller 604 from the take-up position to the cloth seat 606. A stopper 623 holds an empty cloth roller 625 in an empty roll holder 624. A cloth cutting device 626 includes a rotary cutting blade which is driven by an air turbine, and moved in the widthwise direction to cut the cloth. A winding device 627 of this embodiment includes first and second air jet units **627*a* and 627*b* for winding a leading end of the woven cloth around the empty cloth roller 625** installed in the take-up position.

Each weaving machine 601 or 602 has a machine controller 608. The machine controller 60 of each machine is arranged to control each of the removing mechanism 619, the stopper 623, the cutting device 626, and the winding device 627 in the predetermined sequence. To obtain input information, the machine controller 608 of each machine is connected with a presetter 629 for presetting one or more values of the woven cloth length, a rotation sensor 630 for sensing a rotational motion of the surface roller 614, and the cloth roller detector 607. The cloth roller detector 607 is connected with the machine controllers 608 of both machines 601 and 602. The machine controller 608 of each machine has sections for serving as the inhibiting means 620 and the replacement commanding means 603.

Figure 51:
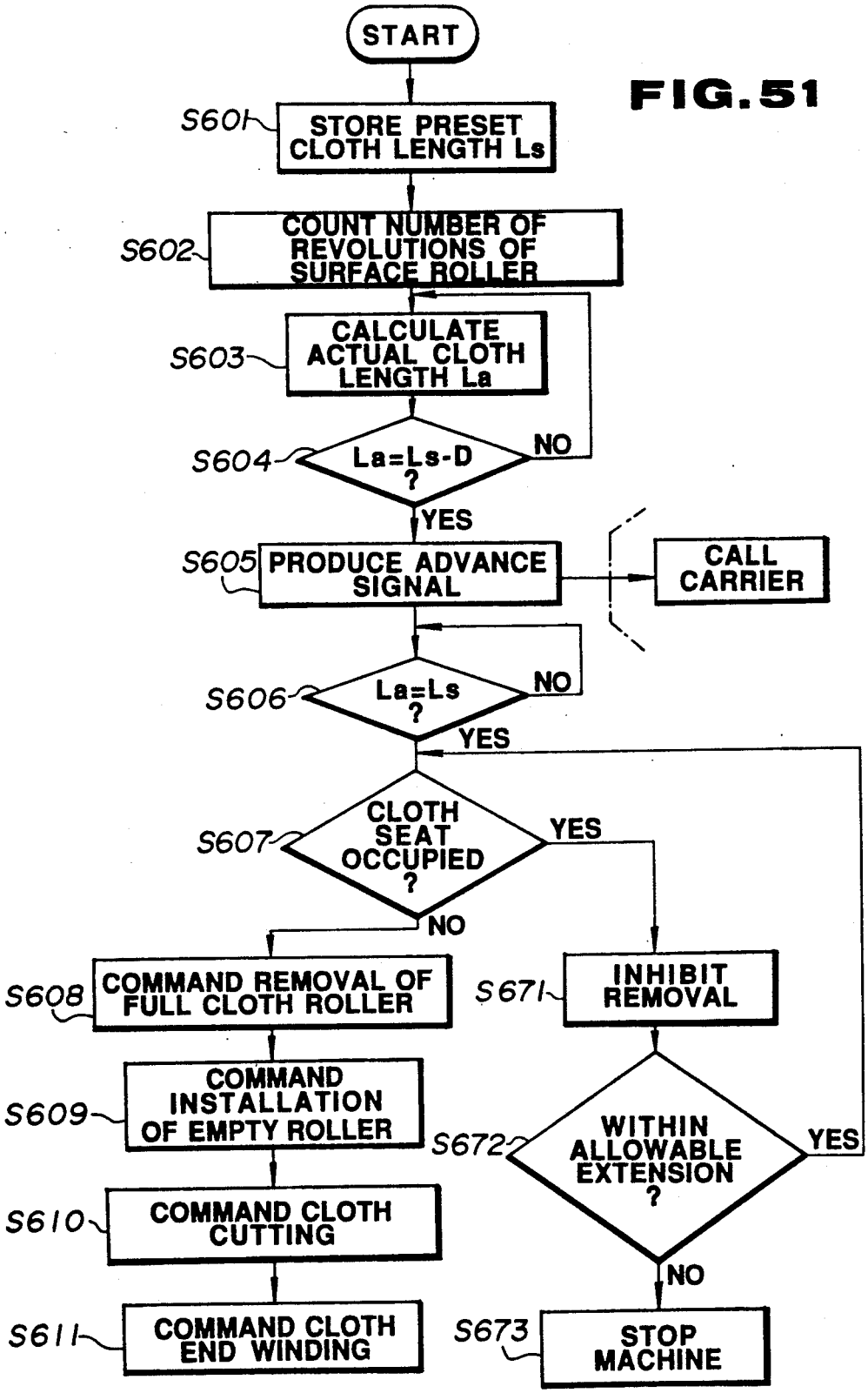
FIG. 51 is a flowchart showing a cloth roller replacement procedure of the sixth embodiment.

FIG. 51 shows a sequence of operations performed by the machine controller 608 of each machine.

At a step S601, the machine controller 608 stores a preset cloth length Ls which is preset through the presetter 629 by an operator. The step S601 corresponds to the presetting means 601 shown in FIG. 49. The machine controller 608 has a device for storing the preset length Ls. Simultaneously with a start of the weaving machine, the machine controller 608 starts counting the number of revolutions of the surface roller 614 by using the signal of the rotation sensor 630 (step S602). The machine controller 608 has a counter such as a register or storage location used for counting the number of revolutions. Then, at a step S603, the machine controller 608 calculates an actual length La of the woven cloth taken up to the cloth roller of the machine by using the number of revolutions of the surface roller 614. The steps S602 and S603 correspond to the cloth length measuring means 602.

At a step S604, the machine controller 608 compares the actual woven cloth length La with a difference obtained by subtracting a preset positive constant D from the preset length Ls. The machine controller 608 repeats the steps S603 and S604 until the actual woven cloth length La becomes equal to the difference Ls−D. When the actual length La reaches the difference Ls−D, then the machine controller 608 produces an advance signal at a step S605, and calls the carrier 609.

At a step S606, the machine controller 608 compares the actual woven cloth length La with the preset cloth length Ls. The normal weaving operation and the cloth length measurement continue until the actual cloth length La reaches the preset length Ls.

When the actual woven cloth length La becomes equal to the preset length Ls, the machine controller 608 determines, at a step S607, whether the cloth seat 606 is occupied or empty, by checking the output signal of the cloth roller detector 607.

If the cloth seat 606 is occupied, then the machine controller 608 inhibits the removal of the cloth roller from the take-up position at a step 671. That is, the inhibiting means 620 inhibits the commanding means 603 from producing the command signal to command the removal of the full cloth roller, by sending an inhibit signal. Therefore, the woven cloth C is further taken up by the full cloth roller. At a step S672, the machine controller 608 determines whether the woven cloth length is within an allowable extension range. If it is not, then the machine controller 608 stops the weaving machine by producing a stop command signal at a step S673.

If the cloth seat 606 is empty, the machine controller 608 proceeds from the step S607 to a step S608. At the step S608, the machine controller 608 commands the replacing mechanism 619 to remove the full cloth roller from the take-up position by outputting the removal command signal almost simultaneously with the reset signal to reset the counter. In response to this command signal, the removing mechanism 619 removes the full cloth roller 604 from the take-up position (in the case of the first machine 601), and the full cloth roller 604 rolls down along the sloping top surface of the cloth seat 606 under the influence of its own weight, and reaches the deepest middle position of the cloth seat 606, a shown in FIG. 50B. It is optional to further provide a cloth holder between the cloth seat 606 and each machine. In this case, the full cloth roller 604 is first transferred from the take-up position to the cloth holder, and then allowed to roll down to the cloth seat 606.

Figure 50C:
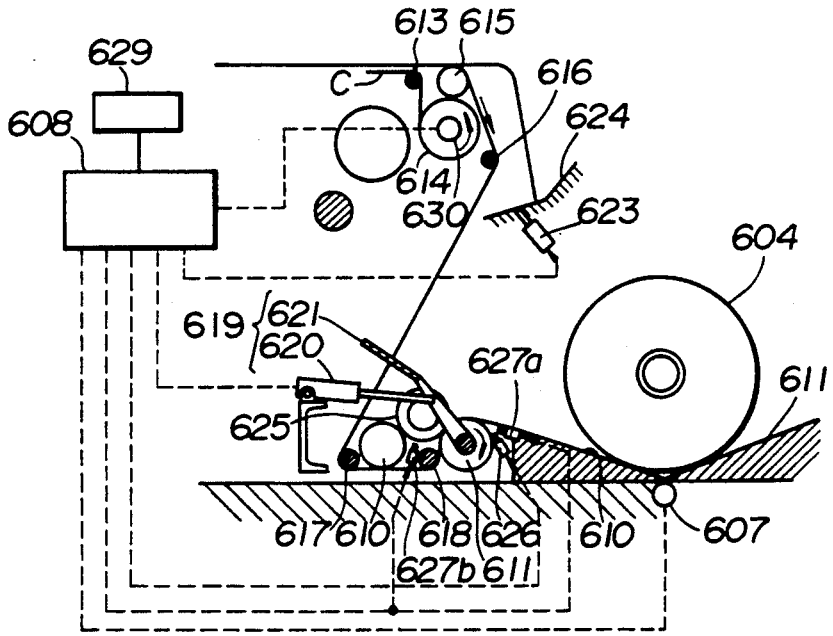

After the removing mechanism returns to its retracted position, the machine controller 608 commands the stopper 623 to release the empty cloth roller 625 by producing an empty cloth installation command signal at a step S609. Therefore, the empty cloth roller 225 falls from the empty roller holder 624 to the take-up position, as shown in FIG. 50C.

Figure 50D:
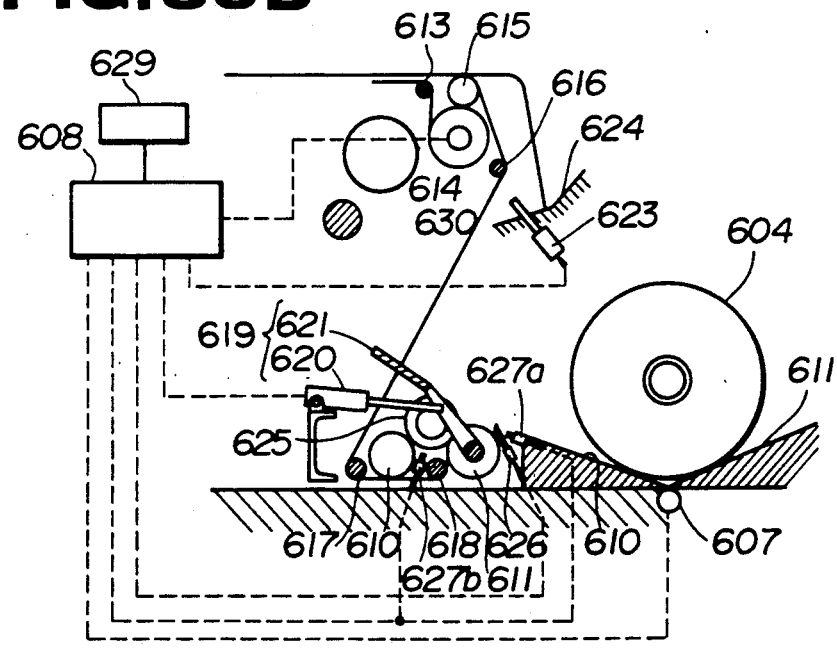

After that, the machine controller 608 commands the cloth cutting device 626 to cut the cloth C by producing a cutting command signal at a step S610. In response to this command signal, the cutting device 626 cuts the cloth C, as shown in FIG. 50D.

Figure 50E:
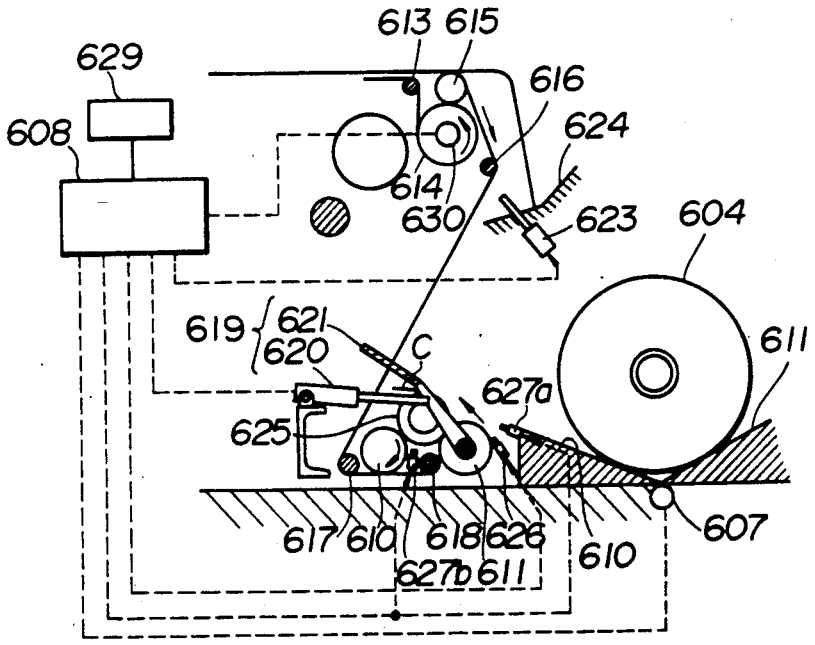

Then, the machine controller 608 commands the winding device 627 to wind the leading cut end of the cloth on the machine, around the empty cloth roller 625 installed in the take-up position, by producing a winding command signal at a step S611. Therefore, the air jet units 627*a* and 627*b* discharges air jets to wind the leading cut end of the cloth on the empty roller 625, as shown in FIG. 50E.

Then, the machine controller 608 returns to the step S602, and repeats the steps S602–S609.

Figures 52A, 52B, 52C:
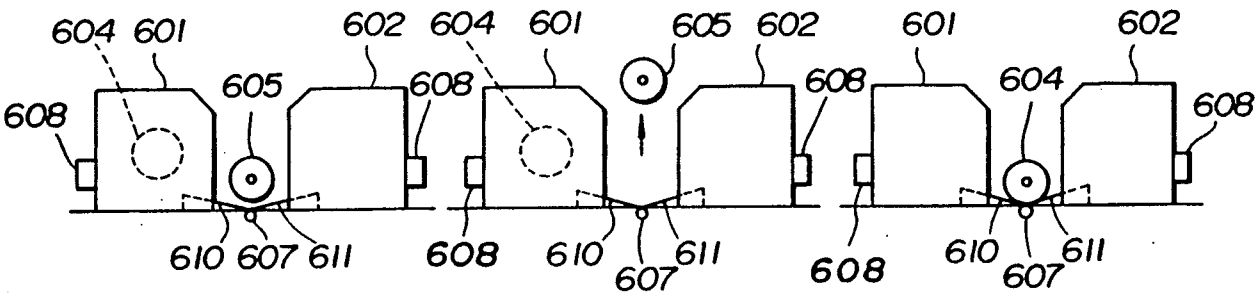
FIGS. 52A–52C are views showing a sequence of operations according to the sixth embodiment for carrying two full cloth rollers from the first and second machines.

The full cloth roller is conveyed from the cloth seat 606 to the storehouse by the carrier 609. When, for example, the cloth roller 605 is first removed from the second machine 602, as shown in FIG. 52A, then the first machine 601 is prohibited from removing the cloth roller 604 therefrom until the full cloth roller 605 is removed from the common cloth seat 606, as shown in FIG. 52B. After the full cloth roller 605 has been removed from the cloth seat, the first machine 601 transfers the full cloth roller 604 from the take-up position to the cloth seat 606, as shown in FIG. 52C. Therefore, the system of the sixth embodiment can prevent collision of the full cloth rollers 604 and 605 as shown in FIG. 55.

Figure 53:
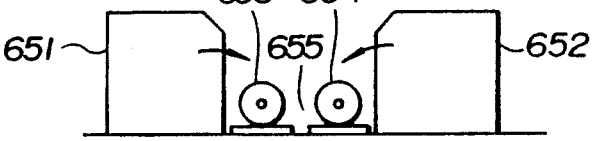
FIG.53 (PRIOR ART)
FIGS. 53 and 54 are front and plan views showing an arrangement of two weaving machines in a conventional system.
Figure 54:
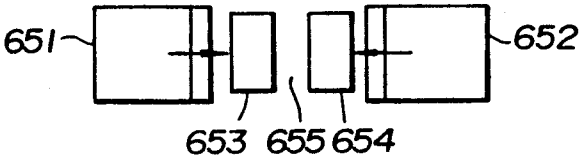
FIG.54 (PRIOR ART)

The system of the sixth embodiment can reduce the space between the first and second machines 601 and 602, as compared with a conventional system shown in FIGS. 53 and 54, requiring the wide space for storing two full cloth rollers 653 and 654 between two machines 651 and 652.

It is possible to employ a limit switch as the cloth roller detector 607 instead of the photoelectric type detector.

What is claimed is:

1. A cloth roller replacement system comprising:

a measuring means for sensing an operating condition of a first weaving machine and producing a measuring signal representing a take-up quantity;

a commanding means for producing a cloth roller replacement command signal when said take-up quantity becomes equal to a predetermined first value;

a presetting means for presetting a second value which is smaller than said first value; and a preparing means for producing an advance signal when said take-up quantity becomes equal to said second value.

2. A system according to claim 1 wherein said preparing means comprises a calling means for demanding an empty cloth roller when said take-up quantity becomes equal to said second value.

3. A system according to claim 2 wherein said calling means includes a means for calling a carrier for supplying an empty cloth roller.

4. A system according to claim 3 wherein said preparing means further comprises a checking means for detecting an empty cloth roller in a predetermined standby position.

5. A system according to claim 4 wherein said checking means includes a means for comparing said take-up quantity with a third value which is greater than said second value, and smaller than said first value, and checking the standby position when said take-up quantity becomes equal to said third value.

6. A system according to claim 5 wherein said checking means is connected with said calling means, and causes said calling means to call the carrier if the standby position is empty.

7. A system according to claim 5 wherein said checking means is connected with an indicating means, and causes said indicating means to produce an alarm signal if the standby position is empty.

8. A system according to claim 1 wherein said preparing means comprises a checking means for detecting an empty cloth roller in a standby position.

9. A system according to claim 1 wherein said system further comprises an actuating means which receives said command signal from said commanding means, and which, upon receipt of said command signal, removes a full cloth roller from a take-up position of the weaving machine, and then installs an empty cloth roller in the take-up position, and said preparing means including a means for putting said actuating means in a ready state in which said actuating means holds an empty cloth roller in a standby position near the take-up position.

10. A system according to claim 9, wherein said actuating means comprises a binding means for binding a full cloth roller in a binding position.

11. A system according to claim 9 wherein said actuating means comprises a carrying means for carrying an empty cloth roller, and said preparing means comprises a calling means for commanding said carrying means to bring an empty cloth roller to the standby position when said take-up quantity becomes equal to said second value.

12. A system according to claim 11 wherein said actuating means further comprises a replacing means for removing a full cloth roller from the take-up position, installing an empty cloth roller in the take-up position, cutting a woven cloth of a full cloth roller, and winding a cut end of a woven cloth on an empty cloth roller installed in the take-up position.

13. A system according to claim 12 wherein said replacing means comprises a removing means for removing a full cloth roller from the take-up position to a receiving position, a holding means for holding an empty cloth roller in the standby position near the take-up position, and a receiving means for receiving a full cloth roller removed from the take-up position and supporting a full cloth roller in the receiving position, and said preparing means includes a means for putting said replacing means in a ready state in which said holding means holds at least one empty cloth roller in the standby position, and said receiving means is ready for receiving a full cloth roller.

14. A system according to claim 13 wherein said actuating means comprises a binding means for binding a full cloth roller in a binding position.

15. A system according to claim 14 wherein said binding means comprises a means for rotating a full cloth roller in the binding position, a means for detecting a trailing end of a cloth of the full cloth roller, and a means for supplying a binder for binding the full cloth roller.

16. A system according to claim 15 wherein said binding means further comprises a guiding means for pressing the trailing cloth end toward an axis of the full cloth roller during a rotational motion of the full cloth roller in the binding position.

17. A system according to claim 16 wherein said binding means is mounted on said receiving means so that the binding position coincides with the receiving position.

18. A system according to claim 17 wherein said carrying means comprises a carrier on which said receiving means is mounted.

19. A system according to claim 17 wherein said receiving means is mounted on the weaving machine.

20. A system according to claim 12 wherein said carrying means comprises a carrier on which said replacing means is mounted.

21. A system according to claim 20 wherein said calling means of said preparing means includes a means for commanding said carrier to come to a predetermined service position in front of the weaving machine.

22. A system according to claim 12 wherein said replacing means is mounted on the weaving machine.

23. A system according to claim 22 wherein said calling means of said preparing means includes a means for commanding said carrying means to supply an empty cloth roller to said replacing means.

24. A system according to claim 1 wherein said commanding means comprises a resetting means for resetting said measuring means to make said take-up quantity equal to zero by producing a reset signal.

25. A system according to claim 1 wherein said system further comprises a common receiving means for receiving a full cloth roller, said common receiving means being disposed between said weaving machine and a second weaving machine so that said common receiving means can receive a full cloth roller from said first and second machines.

26. A system according to claim 25 wherein said system further comprises a means for detecting a condition of said common receiving means to determine whether said common receiving means is occupied or empty, and a means for inhibiting said commanding means from producing said command signal when said common receiving means is occupied.

27. A system according to claim 25 wherein said common receiving means is located at a middle point between said first and second weaving machines.

28. A system according to claim 27 wherein said common receiving means comprises a cloth seat having a first top surface sloping down from a first end of said cloth seat to a middle of said cloth seat, and a second top surface sloping down from a second end of said cloth seat to said middle of said cloth seat, said first and second top surfaces intersecting each other at said middle of said cloth seat and forming a V-shaped symmetrical recess on which a full cloth roller can rest, said middle of said cloth seat being equally distant from take-up positions of said first and second weaving machines, said take-up position of each weaving machines being a position at which a cloth roller is placed to take up a woven cloth.

29. A system according to claim 25 wherein said system further comprises a means for detecting a condition of said common receiving means to determine whether said common receiving means is empty or occupied by a full cloth roller, and producing a priority request signal having an priority indicator to preferentially call a carrier for carrying a full cloth roller away from said common receiving means, if said common receiving means is occupied.

30. A system according to claim 29 wherein said system further comprises a carrying means comprising said carrier, said carrying means receiving said priority request signal, and a normal request signal from a third weaving machine, and said carrying means including further means for sending said carrier to said common receiving means in response to said priority request signal and to said third weaving machine in response to said normal request signal, said carrying means responding to said priority request signal in preference to said normal request signal when said priority and normal request signals are both present simultaneously.

* * * * *